US007962068B2

(12) United States Patent
Kuroda et al.

(10) Patent No.: US 7,962,068 B2
(45) Date of Patent: Jun. 14, 2011

(54) CHARGING MEMBER, PROCESS CARTRIDGE AND ELECTROPHOTOGRAPHIC APPARATUS

(75) Inventors: Noriaki Kuroda, Suntoh-gun (JP); Hisao Kato, Ashigara-gun (JP); Toshinari Miura, Kawasaki (JP); Toshiro Suzuki, Odawara (JP); Takumi Furukawa, Susono (JP); Michitaka Kitahara, Numazu (JP); Jun Murata, Tokyo (JP); Yukinori Nagata, Mishima (JP); Masaki Ozawa, Mishima (JP); Kazuyuki Shishitsuka, Tsukuba (JP); Yoko Kuruma, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 1025 days.

(21) Appl. No.: 11/574,110

(22) PCT Filed: Sep. 1, 2005

(86) PCT No.: PCT/JP2005/016460

§ 371 (c)(1),
(2), (4) Date: Feb. 22, 2007

(87) PCT Pub. No.: WO2006/025597

PCT Pub. Date: Mar. 9, 2006

(65) Prior Publication Data

US 2007/0217823 A1 Sep. 20, 2007

(30) Foreign Application Priority Data

| | | |
|---|---|---|
| Sep. 2, 2004 | (JP) | 2004-255692 |
| Dec. 28, 2004 | (JP) | 2004-379828 |
| May 23, 2005 | (JP) | 2005-149452 |
| Aug. 30, 2005 | (JP) | 2005-248687 |

(51) Int. Cl.
*G03G 21/00* (2006.01)

(52) U.S. Cl. ..... 399/176; 361/225; 428/447; 428/450; 428/451; 492/56

(58) Field of Classification Search ..... 361/225; 399/176; 428/447, 450, 451; 492/56
See application file for complete search history.

(56) References Cited

U.S. PATENT DOCUMENTS

| | | | | |
|---|---|---|---|---|
| 5,625,858 | A | 4/1997 | Hirai et al. | |
| 5,725,922 | A | 3/1998 | Nakamura et al. | 428/36.9 |
| 7,341,813 | B2 * | 3/2008 | Shigezaki et al. | 430/66 |

FOREIGN PATENT DOCUMENTS

| | | | |
|---|---|---|---|
| EP | 0 496 399 | A2 | 7/1992 |
| EP | 0 510 643 | A2 | 10/1992 |
| JP | 10-221929 | | 8/1998 |
| JP | 2002-169355 | | 6/2002 |
| JP | 2003-107927 | | 4/2003 |

* cited by examiner

*Primary Examiner* — D. S Nakarani
(74) *Attorney, Agent, or Firm* — Fitzpatrick, Cella, Harper & Scinto

(57) ABSTRACT

An object of the present invention is to provide a charging member in which a toner, an additive for use in the toner, or the like is hard to adhere to the surface even under repeated use for a long time, and hence the charging and image output are made stable for a long time even if the charging member is used in the DC contact charging method, and a process cartridge and an electrophotographic apparatus having the charging member. The present invention provides a charging member comprising a support, a conductive elastic layer formed on the support, and a surface layer formed on the conductive elastic layer, characterized in that the surface layer contains a polysiloxane having a fluoroalkyl group and an oxyalkylene group, and a process cartridge and an electrophotographic apparatus having the charging member.

10 Claims, 4 Drawing Sheets

CHARGING MEMBER, PROCESS CARTRIDGE AND ELECTROPHOTOGRAPHIC APPARATUS

TECHNICAL FIELD

The present invention relates to a charging member, and a process cartridge and an electrophotographic apparatus having the charging member.

BACKGROUND ART

As one of methods for charging the surface of an electrophotographic photosensitive member, a contact charging method is currently practical.

The contact charging method is a method in which a voltage is applied to a charging member situated to be in contact with the electrophotographic photosensitive member to cause a very low level of electrical discharge near a contact area between the charging member and the electrophotographic photosensitive member, whereby the surface of the electrophotographic photosensitive member is charged.

For the charging member for charging the surface of the electrophotographic photosensitive member, those comprising a support and an elastic layer (conductive elastic layer) provided on the support are commonly used in terms of securing a nip of contact between the electrophotographic photosensitive member and the charging member.

The elastic layer (conductive elastic layer) often contains a relatively large amount of low molecular weight components, and therefore for the purpose of inhibiting the low molecular weight components from bleeding out to contaminate the surface of the electrophotographic photosensitive member, the conductive elastic layer is often provided thereon with a surface layer which is different from the conductive elastic layer and has an elastic coefficient smaller than that of the conductive elastic layer.

As for the shape of the charging member, roller-shaped charging members are commonly used. Hereinafter, the roller-shaped charging member is also referred to as "charge roller".

The method which is most widely used among contact charging methods is a method in which a voltage with an alternating current voltage superimposed on a direct current voltage is applied to the charging member (hereinafter also referred to as "AC+DC contact charging method"). In the case of the AC+DC contact charging method, a voltage having a peak-to-peak voltage twice or more than twice as high as a charge starting voltage is used for the alternating current voltage.

The AC+DC contact charging method is a method enabling highly uniform and stable charge to be done by using the alternating current voltage, but use of an alternating current voltage source incurs upsizing of a charging apparatus and an electrophotographic apparatus and an increase in cost compared with a method in which a voltage with only a direct current voltage is applied to the charging member (hereinafter also referred to as "DC contact charging method").

Namely, the DC contact charging method is a charge method which is excellent in terms of downsizing of the charging apparatus and the electrophotographic apparatus and a reduction in cost compared with the AC+DC contact charging method.

Japanese Patent Application Laid-Open No. 2003-107927 discloses a transfer member having a dynamic friction coefficient of 0.4 or less and surface free energy of 35 dyn/cm or less.

DISCLOSURE OF THE INVENTION

However, the DC contact charging method does not have an effect of improving charge uniformity by the alternating current voltage, and therefore contaminations (toner, additives for use in toner and the like) on the surface of the charging member and unevenness in electrical resistance of the charging member itself tend to appear in an output image.

Particularly, in the case of the DC contact charging method, if a toner, an additive for use in the toner, or the like is unevenly and strongly caused to adhere to the surface of the charging member due to repeated use, the adhering area may cause overcharge or poor charge when a halftone image is output under a high-temperature and high-humidity (30° C./80% RH) environment.

An object of the present invention is to provide a charging member in which a toner, an, additive for use in the toner, or the like is hard to adhere to the surface even under repeated use for a long time, and hence the charging and image output are made stable for a long time even if the charging member is used in the DC contact charging method, and a process cartridge and an electrophotographic apparatus having the charging member.

The present invention provides a charging member comprising a support, a conductive elastic layer formed on the support, and a surface layer formed on the conductive elastic layer, characterized in that the surface layer contains a polysiloxane having a fluoroalkyl group and an oxyalkylene group (hereinafter also referred to as "first charging member of the present invention").

The present invention provides a charging member comprising a support, a conductive elastic layer formed on the support, and a surface layer formed on the conductive elastic layer, characterized in that the surface layer is a layer formed through the steps (VII) and (VIII) (hereinafter also referred to as "second charging member of the present invention"):

(VII) an impregnation step of impregnating a surface region of the conductive elastic layer with a treatment agent containing a copolymer of a siloxane having an isocyanate group on its terminal and at least one of a polyester component and a polystyrene component, and a hydrolyzable compound having a structure expressed by the formula (4):

$$(Z^{41})_h\text{-}M^{41}\text{-}(Rh^{41})_{k-h} \quad (4)$$

wherein h is an integer of 1 or larger, and k is an integer of 3 or larger; $Z^{41}$ represents a monovalent organic group; $M^{41}$ represents an element having a valence of k; and Rh41 represents a hydrolyzable group; and (VIII) an irradiation step of irradiating the surface region of the conductive elastic layer impregnated with the treatment agent with ultraviolet light.

The present invention provides a charging member comprising a support, a conductive elastic layer formed on the support, and a surface layer formed on the conductive elastic layer, characterized in that the surface layer has properties represented by the formulae of (i) to (iii) (hereinafter also referred to as "third charging member of the present invention"):

$$6 < \text{surface free energy}(\gamma_2^{Total}) \leqq 35\ [\text{mJ/m}^2]; \quad (i)$$

$$0.1 \leqq \text{dynamic friction coefficient of surface}(\mu) \leqq 0.3; \text{ and} \quad (ii)$$

$$1.0\times10^{-6} \geqq \text{electrostatic capacity}(C) \geqq 5.0\times10^{-9}\ [F]. \quad (iii)$$

The present invention is a process cartridge having the above-mentioned charging member, and an electrophotographic apparatus.

The present invention can provide a charging member in which a toner, an additive for use in the toner, or the like is hard to adhere to the surface even under repeated use for a long time, and hence the charging and image output are made stable for a long time even if the charging member is used in the DC contact charging method, and a process cartridge and an electrophotographic apparatus having the charging member.

BEST MODE FOR CARRYING OUT THE INVENTION

First, the common configuration of first to third charging members of the present invention (hereinafter also referred to as "charging member of the present invention" collectively) will be described.

The charging member of the present invention comprises a support, a conductive elastic layer formed on the support, and a surface layer formed on the conductive elastic layer. This "surface layer" means a layer situated on the outermost surface of the charging member among layers possessed by the charging member.

The simplest configuration of the charging member of the present invention is a configuration in which two layers: the conductive elastic layer and the surface layer are provided on the support, but one or two other layers may be provided between the support and the conductive elastic layer and between the conductive elastic layer and the surface layer.

The conductive elastic layer and the surface layer may be layers formed by a material for the conductive elastic layer and a material for the surface layer, respectively (hereinafter also referred to as "laminate 1"), or may be formed into a layered structure of the conductive elastic layer and the surface layer (hereinafter also referred to as "laminate 2") by forming a layer using the material for the conductive elastic layer, then modifying a surface region (surface and its adjacent area) of the layer, and determining the modified region to be the surface layer.

Figure 1:
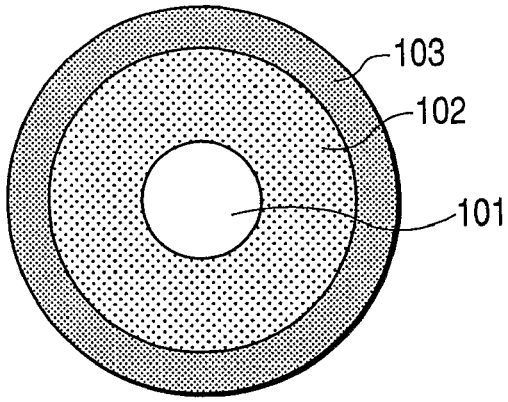
FIG. 1 is one example of the configuration of a charging member of the present invention.

One example of the configuration of the charging member of the present invention is shown in FIG. 1. In FIG. 1, reference numeral 101 denotes a support, reference numeral 102 denotes a conductive elastic layer and reference numeral 103 denotes a surface layer.

The support of the charging member should only have conductivity (conductive support), and supports made of metals (alloys) such as, for example, iron, copper, stainless, aluminum, aluminum alloys and nickel may be used. For the purpose of imparting a scratch resistance, the surface may be subjected to a surface treatment such as a plating treatment within the range not impairing the conductivity.

For the conductive elastic layer, one or more types of elastic materials such as rubbers and thermoplastic elastomers that are used in elastic layers (conductive elastic layers) of conventional charging members may be used.

Rubbers include, for example, urethane rubber, silicone rubber, butadiene rubber, isopropylene rubber, chloroprene rubber, styrene-butadiene rubber, ethylene-propylene rubber, polynorbornane rubber, styrene-butadiene-styrene rubber, acrylonitrile rubber, epichlorohydrin rubber and alkyl ether rubber.

Thermoplastic elastomers include, for example, styrene elastomers and olefin elastomers. Commercially available styrene elastomers include, for example, "Rabalon" manufactured by Mitsubishi Chemical Co., Ltd. and "Septon Compound" manufactured by Kuraray Co., Ltd. Commercially available olefin elastomers include, for example, "Thermorun" manufactured by Mitsubishi Chemical Co., Ltd., "Milastomer" manufactured by Mitsui Petrochemical Industries Co., Ltd., "Sumitomo TPE" manufactured by Sumitomo Chemical Co., Ltd. and "Santoprene" manufactured by Advanced Elastomer Systems Co., Ltd.

The conductivity of the conductive elastic layer can be made to have a predetermined value by appropriately using a conductive agent. The electrical resistance of the conductive elastic layer can be adjusted by appropriately selecting the type and use amount of the conductive agent, and the electrical resistance is preferably in the range of $10^2$ to $10^8\Omega$, more preferably $10^3$ to $10^6\Omega$.

Conductive agents for use in the conductive elastic layer include, for example, cationic surfactants, anionic surfactants, amphoteric surfactants, antistatic agents and electrolytes.

Anionic surfactants include, for example, quaternary ammonium salts such as lauryl trimethylammonium, stearyl trimethylammonium, octadodecyl trimethylammonium, dodecyl trimethylammonium, hexadecyl trimethylammonium and denatured fatty acid/dimethyl ethyl ammonium. Specifically, quaternary ammonium salts include perchlorates, chlorates, hydroborofluorides, ethosulfates and benzyl halides (benzyl bromides, benzyl chlorides, etc.).

Cationic surfactants include, for example, aliphatic sulfonates, higher alcohol sulfates, higher alcohol ethylene oxide added sulfates, higher alcohol phosphates and higher alcohol ethylene oxide added phosphates.

Antistatic agents include, for example, nonionic antistatic agents such as higher alcohol ethylene oxides, polyethylene glycol fatty acid esters and polyalcohol fatty acid esters.

Electrolytes include, for example, salts of metals (Li, Na, K, etc.) of the first group of the periodic table (quaternary ammonium salts, etc.). Specifically, salts of metals of the first group of the periodic table include $LiCF_3SO_3$, $NaClO_4$, $LiAsF_6$, $LiBF_4$, NaSCN, KSCN and NaCl.

As the conductive agent for the conductive elastic layer, salts of metals (Ca, Ba, etc.) of the second group of the periodic table ($Ca(ClO_4)_2$, etc.) and antistatic agents, derived therefrom, which have one or more group (hydroxyl group, carboxyl group, etc.) having active hydrogen capable of reacting with isocyanate (primary amino group, secondary amino group, etc.), may be used. Ionic conductive agents such as complexes of the above-mentioned substances and polyalcohol (1,4-butanediol, ethylene glycol, polyethylene glycol, propylene glycol, polypropylene glycol, etc.) or their derivatives, and complexes of the above-mentioned substances and monool (ethylene glycol monomethyl ether, ethylene glycol monoethyl ether, etc.) may be used.

As the conductive agent for the conductive elastic layer, conductive carbons such as Ketjen Black EC, acetylene black, carbon for rubber, oxidization-treated carbon for color (ink) and pyrolytic carbon may be used. Specifically, as the carbon for rubber, carbons for rubber such as Super Abrasion Furnace (SAF: super abrasion resistance), Intermediate Super Abrasion Furnace (ISAF: semi-super abrasion resistance), High Abrasion Furnace (HAF: high abrasion resistance), Fast Extruding Furnace (FEF: good extrudability), General Purpose Furnace (GPF: general purpose), Semi Rein Forcing Furnace (SRF: medium reinforcement), Fine Thermal Furnace (FT: fine grain thermolysis) and Medium Thermal (MT: medium grain thermolysis) may be used.

As the conductive agent for the conductive elastic layer, graphite such as natural graphite and artificial graphite may be used.

As the conductive agent for the conductive elastic layer, metal oxides such as tin oxide, titanium oxide and zinc oxide, and metals such as nickel, copper, silver and germanium may be used.

As the conductive agent for the conductive elastic layer, conductive polymers such as polyaniline, polypyrrole and polyacetylene may be used.

Inorganic or organic fillers and crosslinking agents may be added to the conductive elastic layer. Fillers include, for example, silica (white carbon), potassium carbonate, magnesium carbonate, clay, talc, zeolite, alumina, barium sulfate and aluminum sulfate. Crosslinking agents include, for example, sulfur, peroxides, crosslinking aids, crosslinking promoters, crosslinking promoter aids and crosslinking retardants.

The hardness of the conductive elastic layer is preferably 70 degrees or greater with Asker C, particularly more preferably 73 degrees or greater in terms of inhibition of deformation of the charging member when the charging member is brought into contact with an electrophotographic photosensitive member which is a charged material.

In the present invention, measurements of the Asker C hardness were made under the condition of an applied load of 1000 g by bringing a push needle of Asker C Hardness Meter (Koubunshi Keiki Co., Ltd.) into contact with the surface of a measurement object.

The elastic coefficient of the surface layer of the charging member is preferably 2000 MPa or less in terms of sufficiently performing the function of the conductive elastic layer provided for sufficiently securing a nip of contact with the electrophotographic photosensitive member. Generally, the crosslinking density tends to decrease as the elastic coefficient of the layer decreases, and therefore the elastic coefficient of the surface layer of the charging member is preferably 100 MPa or greater in terms of inhibition of contamination of the surface of the electrophotographic photosensitive member by low molecular weight components bleeding out to the surface of the charging member.

The effect of inhibiting low molecular weight components from bleeding out is enhanced but the charging capability of the charging member decreases as the thickness of the surface layer increases, and therefore the thickness of the surface layer is preferably 0.1 to 1.0 μm, particularly more preferably 0.2 to 0.6 μm.

The roughness (Rz) of the surface (surface of surface layer) of the charging member is preferably 10 μm or less in JIS94, more preferably 7 μm or less, further more preferably 5 μm or less in terms of inhibiting a toner and additives from adhering to the surface of the charging member.

The first charging member of the present invention will now be described.

As described above, the first charging member of the present invention provides a charging member comprising a support, a conductive elastic layer formed on the support, and a surface layer formed on the conductive elastic layer, characterized in that the surface layer contains a polysiloxane having a fluoroalkyl group and an oxyalkylene group.

The above-mentioned fluoroalkyl groups include, for example, linear or branched alkyl groups with some or all of hydrogen atoms substituted with fluorine atoms. Among them, linear perfluoroalkyl groups having 6 to 31 carbon atoms are preferable.

The above-mentioned oxyalkylene group is a divalent group having a structure expressed by —O—R— (R: alkylene group) (referred to as "alkylene ether group" in some cases). The R (alkylene group) is preferably an alkylene group having 1 to 6 carbon atoms.

The content of the fluoroalkyl group in the above-mentioned polysiloxane is preferably 5.0 to 50.0% by mass based on the total mass of polysiloxane, the content of the oxyalkylene group in the polysiloxane is preferably 5.0 to 70.0% by mass based on the total mass of polysiloxane, and the content of the siloxane moiety in the polysiloxane is preferably 20.0 to 90.0% by mass based on the total mass of polysiloxane.

It is preferable that the above-mentioned polysiloxane further has an alkyl group and a phenyl group. For this alkyl group, a linear or branched alkyl group having 1 to 21 carbon atoms is preferable, and further a methyl group, an ethyl group, an n-propylene group, a hexyl group and a decyl group are more preferable.

If the above-mentioned polysiloxane further has an alkyl group and a phenyl group, the content of the fluoroalkyl group in the above-mentioned polysiloxane is preferably 5.0 to 50.0% by mass based on the total mass of polysiloxane, the content of the oxyalkylene group in the polysiloxane is preferably 5.0 to 30.0% by mass based on the total mass of polysiloxane, the content of the alkyl group in the polysiloxane is preferably 5.0 to 30.0% by mass based on the total mass of polysiloxane, the content of the phenyl group in the polysiloxane is preferably 5.0 to 30.0% by mass based on the total mass of polysiloxane, and the content of the siloxane moiety in the polysiloxane is preferably 20.0 to 80.0% by mass based on the total mass of polysiloxane.

The above-mentioned polysiloxane can be obtained by condensing a hydrolyzable silane compound having a cationically polymerizable group and a hydrolyzable silane compound having a fluoroalkyl group by hydrolysis to obtain a hydrolyzable condensate, and then cleaving the cationically polymerizable group, thereby crosslinking the hydrolyzable condensate.

For the above-mentioned hydrolyzable silane compound having a cationically polymerizable group, a hydrolyzable silane compound having a structure expressed by the formula (2) is suitable.

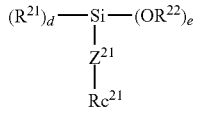

(2)

In the formula (2), $R^{21}$ represents a saturated or unsaturated monovalent hydrocarbon group. $R^{22}$ represents a saturated or unsaturated monovalent hydrocarbon group. $Z^{21}$ represents a divalent organic group. $Rc^{21}$ represents a cationically polymerizable group. d is an integer of 0 to 2, e is an integer of 1 to 3, and d+e is 3.

The cationically polymerizable group represented by $RC^{21}$ in the formula (2) means a cationically polymerizable organic group producing an oxyalkylene group by cleavage, and such groups include, for example, cyclic ether groups such as an epoxy group and an oxethane group and vinyl ether groups. Among them, the epoxy group is preferable in terms of availability and ease of reaction control.

The saturated or unsaturated monovalent hydrocarbon groups represented by $R^{21}$ and $R^{22}$ in the formula (2) include, for example, alkyl groups, alkenyl groups and aryl groups. Among them, linear or branched alkyl groups having 1 to 3 carbon atoms are preferable, and further a methyl group and an ethyl group are more preferable.

The divalent organic groups represented by $Z^{21}$ in the formula (2) include, for example, alkylene groups and arylene groups. Among them, alkylene groups having 1 to 6 carbon atoms are preferable, and further an ethylene group is more preferable.

e in the formula (2) is preferably 3.

If d in the formula (2) is 2, two $R^{21}$s may be the same or different.

If e in the formula (2) is 2 or 3, two or three $R^{22}$s may be same or different.

Specific examples of the hydrolyzable silane compound having the structure expressed by the formula (2) are shown below.

(2-1) glycidoxypropyltrimethoxysilane (2-2) glycidoxypropyltriethoxysilane (2-3) epoxycyclohexylethyltrimethoxysilane (2-4) epoxycyclohexylethyltriethoxysilane For the above-mentioned hydrolyzable silane compound having a fluoroalkyl group, a hydrolyzable silane compound having a structure expressed by the formula (3) is suitable.

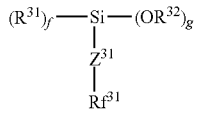

(3)

In the formula (3), $R^{31}$ represents a saturated or unsaturated monovalent hydrocarbon group. $R^{32}$ represents a saturated or unsaturated monovalent hydrocarbon group. $Z^{31}$ represents a divalent organic group. $Rf^{31}$ represents a linear perfluoroalkyl group having 1 to 31 carbon atoms. f is an integer of 0 to 2, g is an integer of 1 to 3, and f+g is 3.

The saturated or unsaturated monovalent hydrocarbon groups represented by $R^{31}$ and $R^{32}$ in the formula (3) include, for example, alkyl groups, alkenyl groups and aryl groups. Among them, linear or branched alkyl groups having 1 to 3 carbon atoms are preferable, and further a methyl group and an ethyl group are more preferable.

The divalent organic groups represented by $Z^{31}$ in the formula (3) include, for example, alkylene groups and arylene groups. Among them, alkylene groups having 1 to 6 carbon atoms are preferable, and further an ethylene group is more preferable.

For the linear perfluoroalkyl group having 1 to 31 carbon atoms represented by $Rf^{31}$ in the formula (3), particularly a linear perfluoroalkyl group having 6 to 31 carbon atoms is preferable in terms of processability.

g in the formula (3) is preferably 3.

If f in the formula (3) is 2, two $R^{31}$s may be same or different.

If g in the formula (3) is 2 or 3, two or three $R^{32}$s may be same or different.

Specific examples of the hydrolyzable silane compound having the structure expressed by the formula (3) are shown below.

(3-1) $CF_3$—$(CH_2)_2$—Si—$(OR)_3$ (3-2) $F(CH_2)_2$—$(CH_2)_2$—Si—$(OR)_3$ (3-3) $F(CF_2)_4$—$(CH_2)_2$—Si—$(OR)_3$ (3-4) $F(CF_2)_6$—$(CH_2)_2$—Si—$(OR)_3$ (3-5) $F(CF_2)_8$—$(CH_2)_2$—S—$(OR)_3$ (3-6) $F(CF_2)_{10}$—$(CH_2)_2$—Si—$(OR)_3$

R in the formula of (3-1) to (3-6) represents a methyl group or ethyl group.

Among the compounds of formulae of (3-1) to (3-6), the compounds of formulae (3-4) to (3-6) are preferable.

For the above-mentioned hydrolyzable silane compound having a cationically polymerizable group and the above mentioned hydrolyzable silane compound having a fluoroalkyl group, only one type or two or more types may be used, respectively.

Particularly, in the case where a hydrolyzable silane compound having the structure expressed by the formula (3) is used as the above-mentioned hydrolyzable silane compound having a fluoroalkyl group, the resultant polysiloxane has perfluoroalkyl groups different in the number of carbon atoms if a hydrolyzable silane compound with $Rf^{31}$ having $n_A$ carbon atoms ($n_A$ is an integer of 6 to 31) and a hydrolyzable silane compound with $Rf^{31}$ having $n_B$ carbon atoms ($n_B$ is an integer of 6 to 31 and $n_B$ is not equal to $n_A$) are used in combination. The perfluoroalkyl group tends to be oriented toward the surface of the charging member, and therefore if the polysiloxane contained in the surface layer of the charging member has perfluoroalkyl groups different in the number of carbon atoms, perfluoroalkyl groups different in length are oriented toward the surface of the charging member. In this case, compared with the case where perfluoroalkyl groups having the same length are oriented toward the surface of the charging member, the concentration of fluorine atoms increases near the surface of the charging member increases and the surface free energy of the charging member decreases, and therefore a toner and additives can be more adequately inhibited from adhering to the surface of the charging member when the charging member is repeatedly used.

If two or more types of hydrolyzable silane compounds having the structure expressed by the formula (3) are used, two or more types are preferably selected from compounds expressed by the formulae of (3-4) to (3-6).

The polysiloxane that is used in the first charging member of the present invention can be obtained by condensing a hydrolyzable silane compound having a cationically polymerizable group and a hydrolyzable silane compound having a fluoroalkyl group by hydrolysis to obtain a hydrolyzable condensate, and then cleaving the cationically polymerizable group, thereby crosslinking the hydrolyzable condensate as described above, but it is preferable that when the hydrolyzable condensate is obtained, the hydrolyzable silane compound having the structure expressed by the formula (1) is further used in addition to the hydrolyzable silane compound having a cationically polymerizable group and the hydrolyzable silane compound having a fluoroalkyl group in terms of control of surface properties of the charging member.

$$(R^{11})_a—Si—(OR^{12})_b \quad (1)$$

In the formula (1), $R^{11}$ represents an alkyl group substituted with a phenyl group or an unsubstituted alkyl group, or an aryl group substituted with an alkyl group or an unsubstituted aryl group. $R^{12}$ represents a saturated or unsaturated monovalent hydrocarbon group. a is an integer of 0 to 3, b is an integer of 1 to 4, and a+b is 4.

The alkyl group of the alkyl group substituted with a phenyl group or the unsubstituted alkyl group represented by $R^{11}$ in the formula (1) is preferably a linear alkyl group having 1 to 21 carbon atoms.

The aryl group of the aryl group substituted with an alkyl group or an unsubstituted aryl group represented by $R^{11}$ in the formula (1) is preferably a phenyl group.

a in the formula (1) is preferably an integer of 1 to 3, particularly more preferably 1.

b in the formula (1) is preferably an integer of 1 to 3, particularly more preferably 3.

The saturated or unsaturated monovalent hydrocarbon groups represented by $R^{12}$ in the formula (1) include, for example, an alkyl group, an alkenyl group and an aryl group. Among them, linear or branched alkyl groups having 1 to 3 carbon atoms are preferable, and further a methyl group, an ethyl group and an n-propyl group are more preferable.

If a in the formula (1) is 2 or 3, two or more $R^{11}$s may be same or different.

If b in the formula (1) is 2, 3 or 4, two, three or four $R^{12}$s may be same or different.

Specific examples of the hydrolyzable silane compound having the structure expressed by the formula (1) are shown below.

(1-1) tetramethoxysilane
(1-2) tetraethoxysilane
(1-3) tetrapropoxysilane
(1-4) methyltrimethoxysilane
(1-5) methyltriethoxysilane
(1-6) methyltripropoxysilane
(1-7) ethyltrimethoxysilane
(1-8)ethyltriethoxysilane
(1-9) ethyltripropoxysilane
(1-10) propyltrimethoxysilane
(1-11) propyltriethoxysilane
(1-12) propyltripropoxysilane
(1-13) hexyltrimethoxysilane
(1-14) hexyltriethoxysilane
(1-15) hexyltripropoxysilane
(1-16) decyltrimethoxysilane
(1-17) decyltriethoxysilane
(1-18) decyltripropoxysilane
(1-19) phenyltrimethoxysilane
(1-20) phenyltriethoxysilane
(1-21) phenyltripropoxysilane
(1-22) diphenyldimethoxysilane
(1-23) diphenyldiethoxysilane In the case where hydrolyzable silane compound having the structure expressed by the formula (1) and the hydrolyzable silane compound having the structure expressed by the formula (3) are used in combination, a in the formula (1) is preferably an integer of 1 to 3, b is preferably an integer of 1 to 3, and one of a $R^{11}$s is preferably a straight chain alkyl group having 1 to 21 carbon atoms, and where the number of carbon atoms of the linear alkyl group having 1 to 21 carbon atoms is n, (n, is an integer of 1 to 21) and the number of carbon atoms of $Rf^{31}$ in the formula (3) is $n_2$ ($n_2$ is an integer of 1 to 31), preferably the requirement of $n_2-1 \leqq n_1 \leqq n_2+1$ is met.

The above-mentioned linear alkyl group having 1 to 21 carbon atoms tends to be oriented toward the surface of the charging member like the perfluoroalkyl group, but if $n_2+2$ is greater than n1, the effect by the perfluoroalkyl group of the hydrolyzable silane compound having the structure expressed by the formula (3) may be poor. If $n_1$ is greater than $n_2-2$, discharge during charging is affected, and when a halftone image is output, a phenomenon (ghost phenomenon) in which characters before the image, black patterns and the like slightly remain tends to occur, although the detailed reason is unknown.

The hydrolyzable silane compound having the structure expressed by the formula (1) may be used in one type or may be used in two or more types. If it is used in two or more types, it is preferable that a hydrolyzable silane compound having an alkyl group as $R^{11}$ in the formula (1) and a hydrolyzable silane compound having a phenyl group as $R^{11}$ in the formula (1) are used in combination. This is because the alkyl group is preferable in terms of control of surface properties of the charging member and the phenyl group is preferable in terms of inhibition of the above mentioned ghost phenomenon.

A specific method for producing the first charging member of the present invention (specific method for forming the surface layer containing a polysiloxane) will be described below.

First, the hydrolyzable silane compound having a cationically polymerizable group and the hydrolyzable silane compound having a fluoroalkyl group, and the above-mentioned other hydrolyzable silane compounds as required are made to undergo a hydrolysis reaction under presence of water to obtain a hydrolyzable condensate.

A hydrolyzable condensate having a desired condensation degree can be obtained by controlling temperature, pH and the like during the hydrolysis reaction.

The condensation degree may be controlled using a metal alkoxide or the like as a catalyst for the hydrolysis reaction during the hydrolysis reaction. Metal alkoxides include, for example, aluminum alkoxide, titanium alkoxide, zirconia alkoxide and the like, and complexes thereof (acetyl acetone complex).

It is preferable that the blending ratio of the hydrolyzable silane compound having a cationically polymerizable group and the hydrolyzable silane compound having a fluoroalkyl group, or the blending ratio of the hydrolyzable silane compound having a cationically polymerizable group, the hydrolyzable silane compound having a fluoroalkyl group and the hydrolyzable silane compound having the structure expressed by the formula (1) for obtaining the hydrolyzable condensate is determined so that the content of the fluoroalkyl group in the obtained polysiloxane is 5.0 to 50.0% by mass based on the total mass of polysiloxane, the content of the oxyalkylene group is 5.0 to 70.0% by mass based on the total mass of polysiloxane, and the content of the siloxane moiety is 20.0 to 90.0% by mass based on the total mass of polysiloxane.

Specifically, the hydrolyzable silane compound having a fluoroalkyl group is blended so that its content is preferably in the range of 0.5 to 20.0 mol %, particularly more preferably in the range of 1.0 to 10.0 mol % based on the total amount of hydrolyzable silane compounds.

If the hydrolyzable silane compound having the structure expressed by the formula (1) is used in combination, it is blended so that the ratio ($M_C$:$M_1$) of the mole ($M_C$) of the hydrolyzable silane compound having a cationically polymerizable group and the mole ($M_1$) of the hydrolyzable silane compound having the structure expressed by the formula (1) is preferably in the range of 10:1 to 1:10.

Then, a coating solution for the surface layer containing the obtained hydrolyzable condensate is prepared, and the prepared coating solution for the surface layer is coated on a member comprising a support and a conductive elastic layer formed on the support (hereinafter also referred to as "conductive elastic member").

When the coating solution for the surface layer is prepared, an appropriate solvent may be used in addition to the hydrolyzable condensate for improving a coating characteristic. Appropriate solvents include, for example, alcohols such as ethanol and 2-butanol, ethyl acetate and methyl ethyl ketone or mixtures thereof. When the coating solution for the surface layer is coated on the conductive elastic member, coating using a roll coater, dipping coating, ring coating or the like may be employed.

Then, an active energy ray is applied to the coating solution for the surface layer coated on the conductive elastic member. Then, the cationically polymerizable group in the hydrolyzable condensate contained in the coating solution for the surface layer is cleaved, whereby the hydrolyzable condensate can be crosslinked. The hydrolyzable condensate is cured by crosslinking.

The active energy ray is preferably ultraviolet light.

Unless when the conductive elastic layer of the conductive elastic member expands due to heat generated during application of the above mentioned active energy, and then shrinks due to cooling, the surface layer adequately follows the expansion and shrinkage, the surface layer may have lots of wrinkles and clacks, but if ultraviolet light is used in the crosslinking reaction, wrinkles and clacks are hard to occur because the hydrolyzable condensate can be crosslinked in a short time (within 15 minutes), and only a small amount of heat is generated.

If the environment where the charging member is placed is an environment where temperature and humidity abruptly changes, wrinkles and clacks may occur in the surface layer unless the surface layer adequately follows expansion/shrinkage of the conductive elastic layer by the change in temperature and humidity, but if the crosslinking reaction is carried out with ultraviolet light generating only a small amount of heat, wrinkles and clacks in the surface layer by the change in temperature and humidity can be inhibited because adhesion between the conductive elastic layer and the surface layer in improved and the surface layer can adequately follow expansion/shrinkage of the conductive elastic layer.

If the crosslinking reaction is carried out with ultraviolet light, degradation of the conductive elastic layer by thermal hysteresis can be inhibited, and therefore degradation of the electrical properties of the conductive elastic layer can be inhibited.

For application of ultraviolet light, a high pressure mercury lamp, a metal halide lamp, a low pressure mercury lamp, an excimer UV lamp and the like may be used, and among them, an ultraviolet light source containing in abundance ultraviolet light having a wavelength of 150 to 480 nm is used.

The integrated amount of ultraviolet light is defined as follows:

integrated amount of ultraviolet light [mJ/cm$^2$]=ultraviolet light intensity [mW/cm$^2$]×irradiation time [s].

An adjustment of the integrated amount of ultraviolet light can be made according to irradiation time, a lamp output, a distance between the lamp and the irradiation object and the like. The integrated amount of ultraviolet light may be made gradient within irradiation time.

If the low pressure mercury lamp is used, the integrated amount of ultraviolet light may be measured using Ultraviolet Light Integrating Actinometer UIT-150-A or UVD-S254 manufactured by Ushio Inc., and if the excimer UV lamp is used, the integrated amount of ultraviolet light may be measured using Ultraviolet Light Integrating Actinometer UIT-150-A or VUV-S172 manufactured by Ushio Inc.

It is preferable that during the crosslinking reaction, a cationic polymerization catalyst (polymerization initiator) is made to coexist in terms of improvement in crosslinking efficiency. For example, since the epoxy group shows a high reactivity with an onium salt of a Lewis acid activated by the active energy ray, the onium salt of the Lewis acid is preferably used as a cationic polymerization catalyst if the above-mentioned cationically polymerizable group is an epoxy group.

Other cationic polymerization catalysts include, for example, borates, compounds having an imide structure, compounds having a triazine structure, azo compounds and peroxides.

Among various kinds of cationic polymerization catalysts, aromatic sulfonium salts and aromatic iodonium salts are preferable in terms of sensitivity, stability and reactivity, and particularly a bis(4-tert-butylphenyl)iodonium salt, a compound having a structure expressed by the following formula:

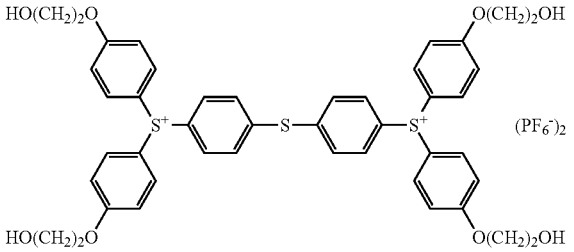

(trade name: ADEKA optomer SP-150 manufactured by Asahi Denka Co., Ltd.), and a compound having a structure expressed by the following formula:

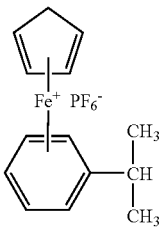

(trade name: Irgacure 261 manufactured by Ciba Specialty Chemicals Inc).

The use amount of cationic polymerization catalyst is preferably 1 to 3% by mass based on the amount of hydrolyzable condensate.

The second charging member of the present invention will now be described.

As described above, the second charging member of the present invention provides a charging member comprising a support, a conductive elastic layer formed on the support, and a surface layer formed on the conductive elastic layer, characterized in that the surface layer is a layer formed through the steps (VII) and (VIII):

(VII) impregnation step of impregnating a surface region of the conductive elastic layer with a treatment agent containing a copolymer of a siloxane having an isocyanate group on its terminal and at least one of a polyester component and a polystyrene component, and a hydrolyzable compound having a structure expressed by the formula (4):

$$(Z^{41})_h\text{-}M^{41}\text{-}(Rh^{41})_{k-h} \quad (4)$$

wherein h is an integer of 1 or larger, and k is an integer of 3 or larger; $Z^{41}$ represents a monovalent organic group; $M^{41}$ represents an element having a valence of k; and $Rh^{41}$ represents a hydrolyzable group; and (VIII) an irradiation step of irradiating the surface region of the conductive elastic layer impregnated with the treatment agent with ultraviolet light.

For the above-mentioned siloxane having an isocyanate group on its terminal, siloxanes having structures expressed by the formulae (i-1) to (i-4) are preferable.

(i-1)

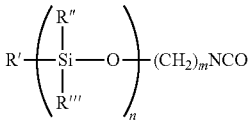

(i-2)

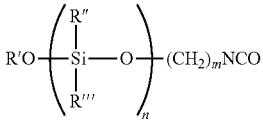

(i-3)

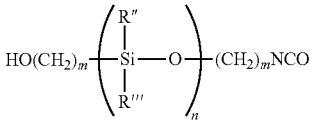

(i-4)

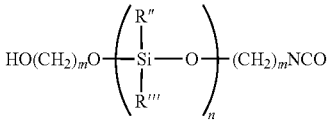

In the formulae (i-1) to (i-4), R', R" and R'" each independently represent a substituted or unsubstituted monovalent hydrocarbon group having 1 to 8 carbon atoms. m is an integer of 1 or greater, and n is an integer of 1 or greater.

Monovalent hydrocarbon groups having 1 to 8 carbon atoms include, for example, alkyl groups such as a methyl group, an ethyl group, a propyl group and a butyl group, alkenyl groups such as a vinyl group and an allyl group, aryl groups such as a phenyl group, and aralkenyl groups such as a benzyl group.

Hydrolyzable groups represented by $Rh^{41}$ of the formula (4) include, for example, alkoxy groups such as a methoxy group and an ethoxy group, enoxy groups such as a propenoxy group, acyloxy groups such as an acetoxy group, ketoxym groups such as a butanoxym group, an amino group, an amide group, an aminoxym group and an alkenyloxy group.

Monovalent organic groups represented by $Z^{41}$ of the formula (4) include, for example, organic functional groups such as an amino group, a methacryl group, a vinyl group, an epoxy group and a mercapto group and alkyl groups.

Elements having a valence of k ($k \geqq 3$), represented by $M^{41}$ of the formula (4) include, for example, Si, Ti, Al, Sn and Zr. Among them, Si is preferable (the hydrolyzable compound having Si as $M^{41}$ is hereinafter also referred to as "hydrolyzable silane compound").

h in the formula (4) is preferably 1, and k is preferably 4.

h $Z^{41}$ s in the formula (4) may be same or different.

If k-h in the formula (4) is 2 or greater, (k-h) $Rh^{41}$ may be same or different.

The above-mentioned hydrolyzable silane compounds include, for example, vinyltriethoxysilane, vinyltrimethoxysilane, vinyltris(β-methoxyethoxy)silane, γ-methacryloxypropyltrimethoxysilane, β-(3,4-epoxycyclohexyl)ethyltrimethoxysilane, γ-glycidoxypropyltrimethoxysilane, γ-mercaptopropyltrimethoxysilane, γ-aminopropyltriethoxysilane, N-β-(aminoethyl)-γ-aminopropyltrimethoxysilane, γ-ureidopropyltriethoxysilane, phenyltriethoxysilane, methyltriethoxysilane, methyltrimethoxysilane, a polyethylene oxide-modified silane monomer, polymethylethoxysiloxane, hexamethyldisilazane, methyltris(dimethylketoxime)silane, methyltris(methylethylketoxime)silane, ethyltris(methylethylketoxime)silane, methyltris(methylisobutylketoxime)silane, vinyltris(methylethylketoxime)silane, vinyltributanoximesilane, methyltrimethoxysilane, methyltriacetoxysilane, methyltriisopropenoxysilane, vinyltrimethoxysilane and vinyltriacetoxysilane. Among them, γ-methacryloxypropyltrimethoxysilane and methyltris(methylethylketoxym) are preferable.

Acid components for obtaining the above-mentioned polyester components include, for example, succinic acid, maleic acid, fumaric acid, glutaric acid, adipic acid, azelaic acid, sebacic acid, dodecanedicarboxylic acid, phthalic acid (isophthalic acid, terephthalic acid, etc.), tetrahydrophthalic acid and hexahydrophthalic acid. Glycol components for obtaining the above-mentioned polyester components include, for example, ethylene glycol, propylene glycol, butanediol, neopentylglycol, pentadiol, hexanediol, octanediol, nonanediol and decanediol.

In the present invention, the above-described polystyrene components include not only polymers of styrene ($C_6H_5$—CH═$CH_2$) but also polymers of derivatives of styrene. Such polystyrene components include, for example, poly(alkylstyrenes) such as poly(p-, m- or o-methylstyrene), poly(2,4-, 2,5-, 3,4- or 3,5-dimethylstyrene) and poly(p-tert-butylstyrene), poly(styrene halides) such as poly(p-, m- or o-chlorostyrene), poly(p-, m- or o-bromostyrene), poly(p-, m- or o-fluorostyrene) and poly(o-methyl-p-fluorostyrene), poly (alkylstyrene halaids) such as poly(p, m- or o-chloromethylstyrene), poly(alcoxystyrenes) such as poly(p-, m- or o-methoxystyrene) and poly(p-, m- or o-ethoxystyrene), poly (carboxyalkylstyrenes) such as poly(p-, m- or o-carboxymethylstyrene), poly(alkyletherstyrenes) such as poly(p-vinylbnzylpropylether), poly(alkylsilylstyrenes) such poly(p-trimethylsilylstyrene), and poly(vinylbenzyldimethoxyphosphide).

A specific method for producing the second charging member of the present invention will be described below.

First, a copolymer of a siloxane having an isocyanate group on its terminal and at least one of a polyester component and a polystyrene component is obtained. At this time, the ratio ($m_1$:$m_p$) of the mass ($m_1$) of the siloxane having an isocyanate group on its terminal and the total mass ($m_p$) of the polyester component and the polystyrene component is preferably 100:0 to 60:40, particularly more preferably 80:20 to 70:30. The extent to which a toner and additives adhere to the surface of the charging member due to repeated use tends to decrease as the amount of siloxane having an isocyanate group on its terminal.

Then, the copolymer of the siloxane having an isocyanate group on its terminal and at least one of a polyester component and a polystyrene component, and the hydrolyzable compound having the structure expressed by the formula (4) are dissolved in a solvent (organic solvent) to prepare the above-mentioned treatment agent. The ratio of the hydrolyzable compound having the structure expressed by the formula (4) in the above-mentioned treatment agent is preferably 0.5% by mass or greater based on units originating from the siloxane having an isocyanate group on its terminal in the above-mentioned copolymer, while it is preferably less than 10% by mass, more preferably less than 5% by mass. If the amount of hydrolyzable compound having the structure expressed by the formula (4) is too large, the amount of unreacted hydrolyzable compound increases during a curing reaction by application of ultraviolet light in a subsequent step, and this unreacted hydrolyzable compound may bloom on the surface of the charging member in a large amount. If the unreacted hydrolyzable compound blooms on the surface of the charging member in a large amount, the electrophotographic photosensitive member to be charged may be contaminated.

For the above-mentioned solvent (organic solvent), ethyl acetate, methyl ethyl ketone and toluene are preferable in terms of ease of treatment, ease of drying and the like. The solvent (organic solvent) may be used in only one type, or may be used in two or more types.

The concentration of the treatment agent (concentration of components other than the solvent in the treatment agent) is preferably 10% by mass or less, particularly more preferably 5% by mass or less in terms of ease of impregnation. As the concentration of the treatment agent decreases, the viscosity of the treatment agent decreases, and therefore it becomes easier to coat the treatment agent on the conductive elastic member uniformly.

Then, the prepared treatment agent is coated on a member (conductive elastic member) comprising a support and a conductive elastic layer formed on the support, and a surface region of the conductive elastic layer is impregnated with the treatment agent. When the treatment agent is coated on the conductive elastic member, coating using a roll coater, dipping coating, ring coating or the like may be employed.

Then, ultraviolet light is applied to the surface region of the conductive elastic layer impregnated with the treatment agent.

When the surface region of the conductive elastic layer is impregnated with the treatment agent, water in the conductive elastic layer causes a urethane reaction between isocyanate and the hydrolyzable compound, resulting in a urethane bond. With this part serving as a crosslinking point in curing (ultraviolet curing), components of the treatment agent and the conductive elastic layer are strongly fixed together.

If a copolymer containing a polyester component is used as the above-mentioned copolymer, the urethane bond is also produced between the terminal hydroxyl group of the polyester component and the isocyanate group possessed by the above-mentioned siloxane on its terminal, and thus the components of the treatment agent and the conductive elastic layer are more strongly fixed together.

The surface region modified by impregnation of the above-mentioned treatment agent and application of ultraviolet light in the conductive elastic layer of the conductive elastic member corresponds to the surface layer of the second charging member of the present invention. The region not modified in the conductive elastic layer of the conductive elastic member corresponds to the conductive elastic layer of the second charging member of the present invention.

For application of ultraviolet light, a high pressure mercury lamp, a metal halide lamp, a low pressure mercury lamp, an excimer UV lamp and the like may be used, and among them, an ultraviolet light source containing in abundance ultraviolet light having a wavelength of 150 to 480 nm is used.

Definition of the integrated amount of ultraviolet light is as described above.

The third charging member of the present invention will now be described.

As a result of conducting studies on which properties of various kinds of properties of the charging member play a role in solving the above-mentioned problems based on the first and second charging members of the present invention, the present inventors found that principally, chemical and physical properties, and further electrical properties of the surface layer (surface) of the charging member play a role in solving the above-mentioned problems, leading to completion of an invention relating to the third charging member of the present invention.

As described above, the third charging member of the present invention provides a charging member comprising a support, a conductive elastic layer formed on the support, and a surface layer formed on the conductive elastic layer, characterized in that the surface layer has properties represented by the formulae of (i) to (iii) (hereinafter also referred to as "third charging member of the present invention"):

$$6<\text{surface free energy}(\gamma_2^{Total})\leqq 35\ [\text{mJ/m}^2]; \quad \text{(i)}$$

$$0.1\leqq\text{dynamic friction coefficient of surface }(\mu)\leqq 0.3;\ \text{and} \quad \text{(ii)}$$

$$1.0\times10^{-6}\geqq\text{electrostatic capacity}(C)\geqq 5.0\times10^{-9}\ [\text{F}]. \quad \text{(iii)}$$

The above-mentioned surface free energy ($\gamma_2^{Total}$) is a parameter representing the chemical properties of the surface layer (surface) of the charging member, the above described dynamic friction coefficient of surface ($\mu$) represents the physical properties of the surface layer (surface) of the charging member, and the above-mentioned electrostatic capacity (C) is a parameter representing the electrical properties of the surface layer of the charging member.

First, the surface free energy ($\gamma_2^{Total}$) of the charging member will be described.

The surface free energy ($\gamma_2^{Total}$) of the charging member of the present invention is greater than 6 mJ/m$^2$ and equal to or less than 35 mJ/m$^2$. A toner and additives become harder to adhere to the surface of the charging member as the surface free energy decreases. The inventors believe that for reducing the surface free energy, a methyl trifluoride group (—$CF_3$) is the most effective. If the methyl trifluoride group occupies the entire surface region of the charging member, the surface free energy of the charging member is theoretically 6 mJ/m$^2$.

A difference between the surface free energy ($\gamma_1^{Total}$) of the conductive elastic layer and the surface free energy ($\gamma_2^{Total}$) of the charging member is preferably 10 mJ/m$^2$ or greater in terms of inhibiting low molecular weight components in the conductive elastic layer from bleeding out to the surface of the charging member. If a plasticizer or the like is incorporated in the conductive elastic layer to adjust its elasticity coefficient for sufficiently securing a nip of contact with the electrophotographic photosensitive member, the surface free energy of the conductive elastic layer tends to increase as the amount of plasticizer increases, and thus compatibility with low molecular weight components is compromised, and the low molecular weight components tend to bleed out, and therefore the surface free energy ($\gamma_1^{Total}$) of the conductive elastic layer is preferably 40 mJ/m$^2$ or less.

The surface free energy of the charging member and the surface free energy of the conductive elastic layer are measured using probe liquids shown in Table 1 with known surface free energy three components.

TABLE 1

| Probe liquids | Kitazaki-Hata Theory | | | |
|---|---|---|---|---|
| | $\gamma L^d$ | $\gamma L^p$ | $\gamma L^h$ | $\gamma L^{Total}$ |
| Water | 29.1 | 1.3 | 42.4 | 72.8 |
| Diiodomethane | 46.8 | 4.0 | 0.0 | 50.8 |
| Ethylene glycol | 30.1 | 0.0 | 17.6 | 47.7 |

Unit: $mJ/m^2$

Specifically, the contact angles θ of the above-mentioned probe liquids at the surface of the charging member/the surface of the conductive elastic layer are measured using Contact Angle Meter CA-X ROLL Model manufactured by Kyowa Kaimen Co., Ltd., three equations are made from surface free energies $\gamma L^d$, $\gamma L^p$ and $\gamma L^h$ of three types of probe liquids in Table 1 and contact angles θ determined respectively using the following Kitazaki/Hata equation:

$$\sqrt{\gamma L^d \times \gamma S^d} + \sqrt{\gamma L^p \times \gamma S^p} + \sqrt{\gamma L^h \times \gamma S^h} = \frac{\gamma L(1+\cos\theta)}{2},$$

the ternary simultaneous equation is solved to calculate $\gamma s^d$, $\gamma s^p$ and $\gamma s^h$, and the sum of $\gamma s^d$, $\gamma s^p$ and $\gamma s^h$ is determined to be surface free energy of the charging member/surface free energy of the conductive elastic layer.

Detailed conditions for measurement of the contact angle θ are as follows:

measurement: liquid drop method (circle fitting);
liquid volume: 1 μl;
drop recognition: automatic;
image processing: algorithm-unreflective;
image mode: frame; and
threshold level: automatic.

The dynamic friction coefficient (μ) of the surface of the charging member will now be described.

The dynamic friction coefficient (μ) of the third charging member of the present invention is in the range of 0.1 to 0.3. If the dynamic friction coefficient is too large when the charging member rotates with the electrophotographic photosensitive member, the charging member tends to be deformed in an arc form along the direction of rotation during rotation, and if the charging member is deformed in an arc form, a toner and additives may partially adhere to the surface of the charging member, or a region where the toner and additives adhere may increase. If the dynamic friction coefficient is too small when the charging member rotates with the electrophotographic photosensitive member, the charging member may be hard to rotate.

In the present invention, the dynamic friction coefficient (μ) of the surface of the charging member means a value measured in the following manner. This measurement method conforms to the Euler's belt method.

Figure 2:
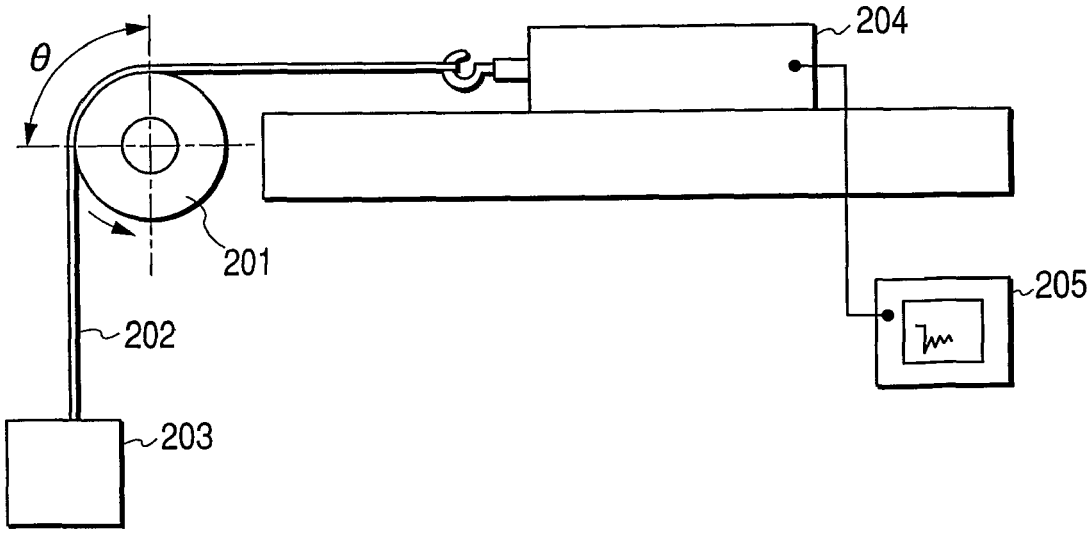
FIG. 2 is a schematic diagram of a measuring machine for use in measurement of a dynamic friction coefficient.

A schematic diagram of a measuring machine used for measurement of the dynamic friction coefficient in the present invention is shown in FIG. 2.

In FIG. 2, reference numeral 201 denotes a charging member to be measured, reference numeral 202 denotes a belt in contact with the charging member at a predetermined angle θ (thickness: 100 μm, width: 30 mm, length: 180 mm, made of polyethylene terephthalate (PET) (trade name: Lumirror S10 #100 manufactured by Toray Industries Inc.), reference numeral 203 denotes a sinker hooked to one terminal of the belt 202, reference numeral 204 denotes a load meter hooked to the other terminal of the belt 202, and reference numeral 205 denotes a recorder connected to the load meter 204.

If a force measured by the load meter 204 is F [g weight] and the sum of the weight of the sinker and the weight of the belt is W [g weight] when the charging member 201 is rotated along a predetermined direction and at a predetermined speed in the state shown in FIG. 2, the friction coefficient is determined according to the following formula.

$$\text{friction coefficient} = (1/\theta)\ln(F/W)$$

Figure 3:
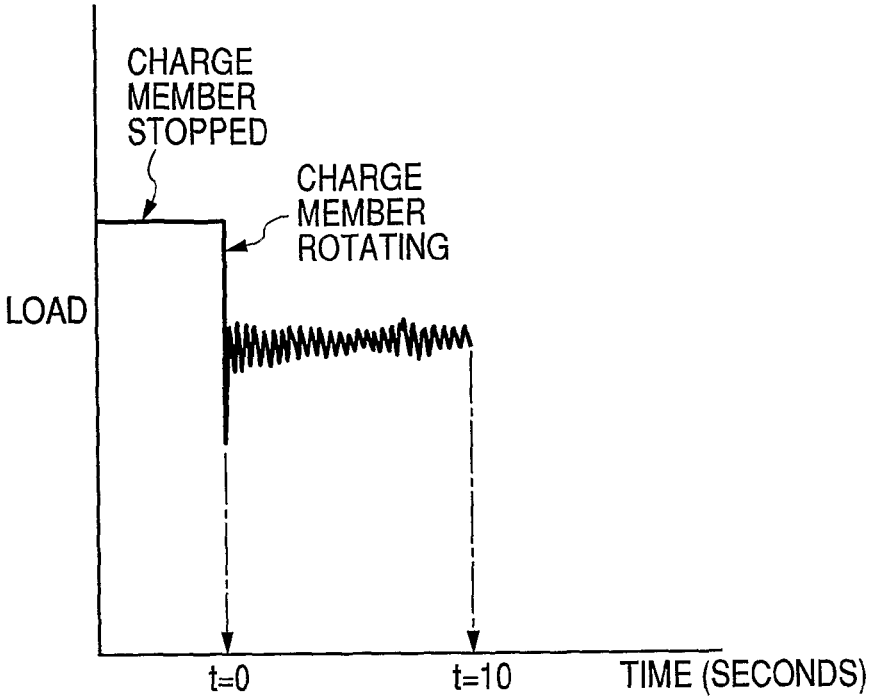
FIG. 3 shows one example of a chart.

One example of a chart obtained by this measurement method is shown in FIG. 3.

Since the value immediately after the charging member is rotated represents a force required for starting the rotation and the subsequent value represents a force required continuing the rotation, the friction coefficient at a rotation starting point (i.e. time point of t=0 [second]) is a static friction coefficient and the friction coefficient at any time of t>0 [second] is a dynamic friction coefficient at any time. In the present invention, the friction coefficient obtained after 10 seconds after the rotation starting point is determined to be the above-described dynamic friction coefficient (μ).

In the present invention, W equals 100 [g weight], the rotation speed of the charging member is 115 rpm, and measurements are made under an environment of 23° C./53% RH.

The electrostatic capacity (C) of the surface layer of the charging member will now be described.

The electrostatic capacity (C) of the surface layer of the third charging member of the present invention is in the range of $5.0\times10^{-9}$ F to $1.0\times10^{-6}$ F. As the electrostatic capacity increases, an electrostatic repulsive force increases, and thus the toner and additives become hard to adhere to the surface of the charging member, but if the electrostatic capacity is too large, a ghost phenomenon may occur.

In the present invention, the electrostatic capacity of the surface layer of the charging member is measured in the following manner.

First, the charging member to be measured is left standing under an environment of 30° C./80% RH for 24 hours.

Figure 4:
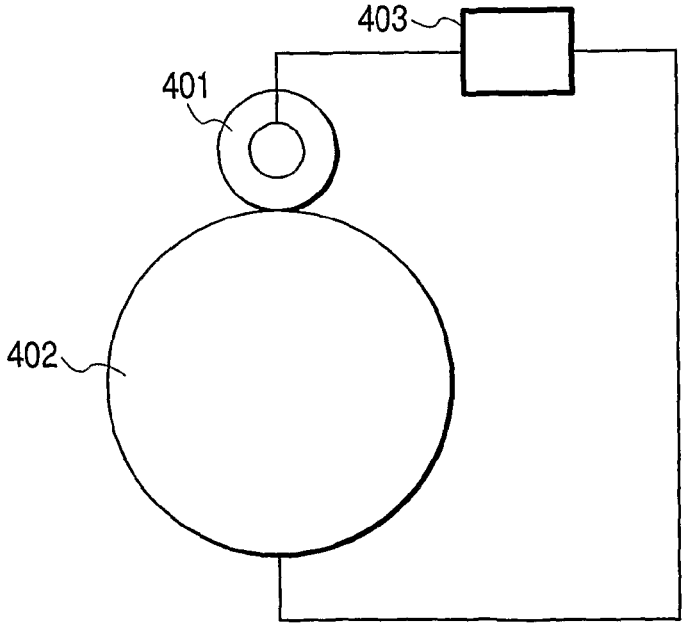
FIG. 4 shows the configuration of a measuring apparatus for measurement of an electrostatic capacity.
Figure 5:
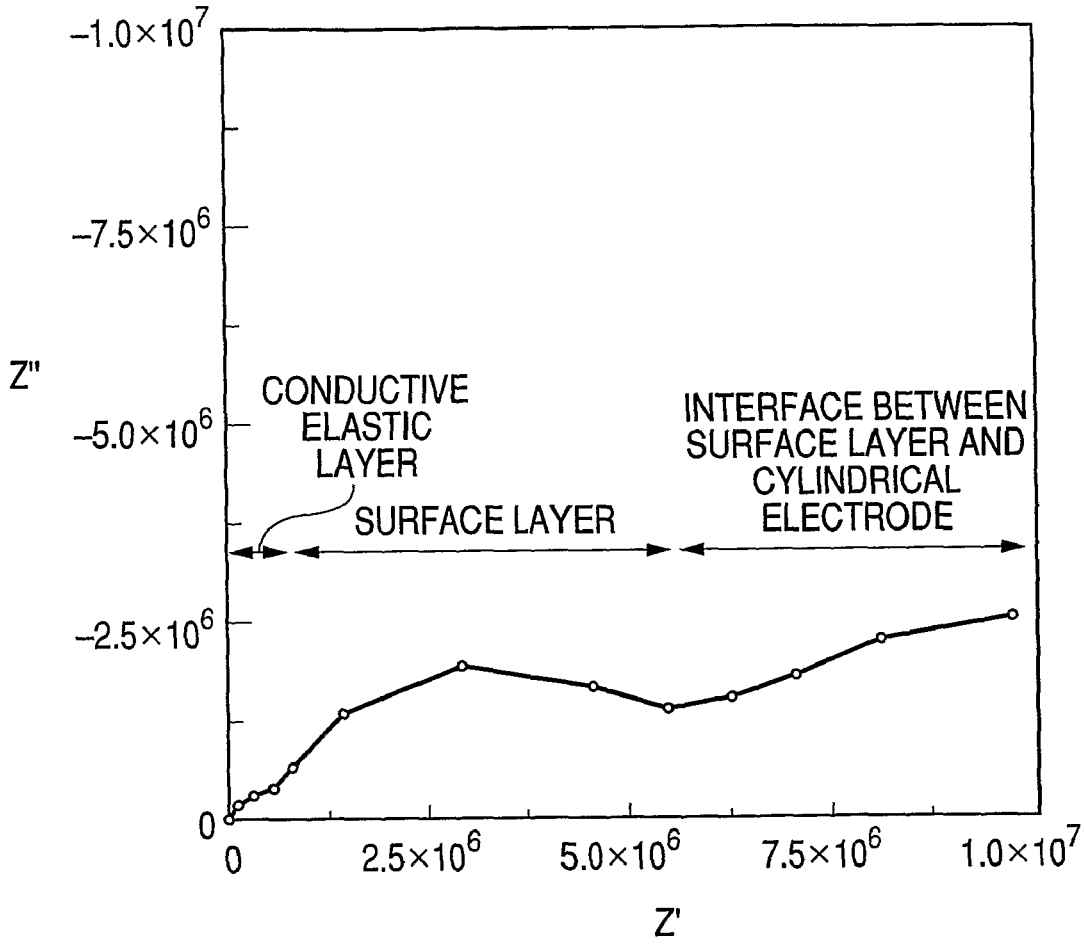
FIG. 5 shows an impedance property.

Then, the charging member is mounted on a measuring apparatus having a configuration shown in FIG. 4, and the dielectric constant is measured under conditions of an applied voltage of 3 V and a measurement frequency of 0.1 Hz to 1 MHz. As a result of he measurement, for example, an impedance characteristic shown in FIG. 5 is obtained.

Figure 6:
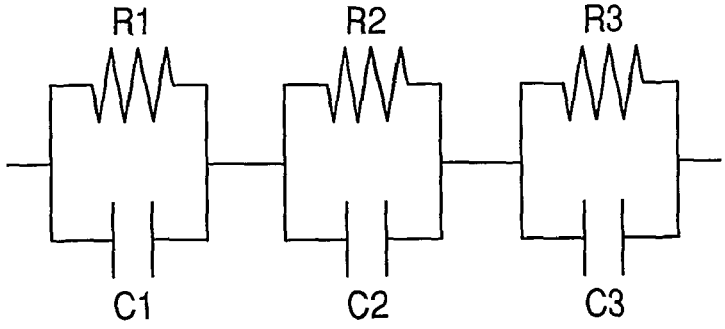
FIG. 6 is an imaginary view of RC-parallel equivalent circuits in a conductive elastic layer, an interface between the conductive elastic layer and a surface layer, and the surface layer.

Then, RC parallel equivalent circuits in the conductive elastic layer, the surface layer, and the interface between the surface layer and a cylindrical electrode are imagined for the charging member as shown in FIG. 6, and assuming that the resistance of the conductive elastic layer is R1 and the electrostatic capacity thereof is C1, the resistance of the surface layer is R2 and the electrostatic capacity thereof is C2, the resistance of the interface between the surface layer and the cylindrical electrode is R3 and the electrostatic capacity thereof is C3, the value of C2 is calculated.

In FIG. 4, reference numeral 401 denotes a charging member, reference numeral 402 denotes a cylindrical electrode (metallic roller), and reference numeral 403 denotes a dielectric constant measuring system (1296 Model Dielectric Constant Measuring Interface in combination with 1260 Model Impedance Analyzer manufactured by SOLARTRON Co., Ltd., U.K.).

The third charging member of the present invention can be produced in the same manner as, for example, the first charging member of the present invention and the second charging member of the present invention described above, and the above-mentioned parameters can be adjusted to be desired values by appropriately adjusting the types and blending ratios of materials used, and further the roughness of the surface and the thickness of the surface layer.

Figure 7:
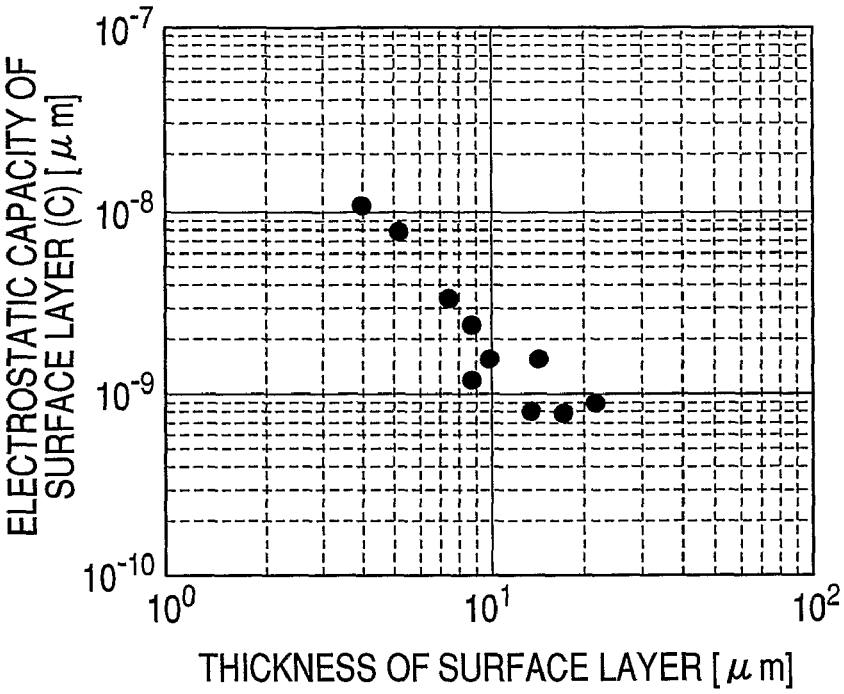
FIG. 7 shows a relation between the thickness of the surface layer and the electrostatic capacity of the surface layer.

For example, the above-mentioned application of ultraviolet light oxidizes the surface of the charging member, and therefore the surface free energy of the charging member tends to increase (see FIG. 7). By use of the above-mentioned treatment agent, an increase in surface free energy of the charging member can be inhibited although the above-mentioned application of ultraviolet light is carried out, and also the surface of the charging member can be roughened to some extent to decrease the dynamic friction coefficient thereof. The electrostatic capacity of the surface layer tends to decrease as the thickness of the surface layer is increased, and the electrostatic capacity of the surface layer tends to increase as the thickness of the surface layer is decreased. In terms of limitation of the electrostatic capacity within the above-mentioned range, the thickness of the surface layer is preferably 5.0 μm or less, more preferably 3.0 μm or less, further more preferably 1.0 μm or less.

For the first and second charging members of the present invention, excellent effects can be obtained as described above if the above-mentioned requirements are met, respectively, but in terms of obtaining more remarkably excellent effects, it is preferable that $\gamma_2^{Total}$, C and μ, and $\gamma_1^{Total}$ of these charging members also meet the above-mentioned requirements.

Figure 8:
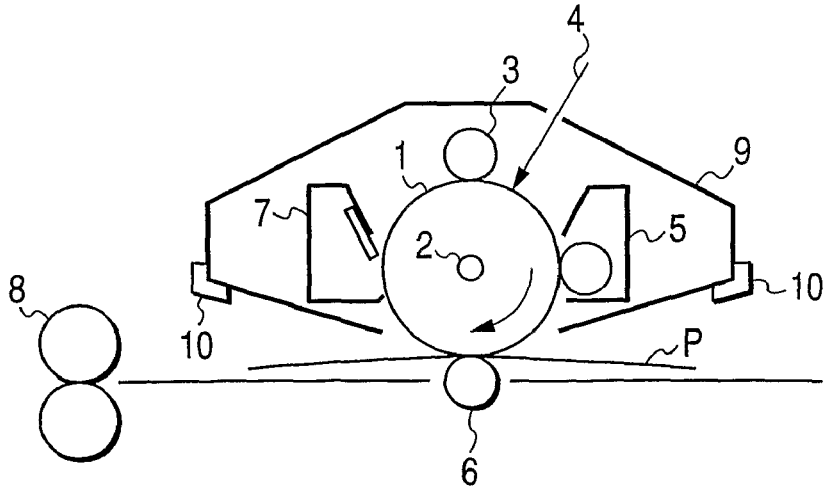
FIG. 8 shows one example of the outlined configuration of an electrophotographic apparatus comprising a process cartridge having the charging member of the present invention.

One example of the outlined configuration of an electrophotographic apparatus comprising a process cartridge having the charging member of the present invention is shown in FIG. 8.

In FIG. 8, reference numeral 1 denotes a cylindrical electrophotographic photosensitive member, which is rotationally driven at a predetermined circumferential speed in the arrow direction around an axis 2. The electrophotographic photosensitive member generally has a support and an inorganic or organic photosensitive layer formed on the support. The electrophotographic photosensitive member may have a charge injection layer as a surface layer.

The surface of the electrophotographic photosensitive member 1 rotationally driven is uniformly charged to a predetermined positive or negative potential by a charging member 3 (roller-shaped charging member in FIG. 8) of the present invention, and then receives exposure light (image exposure light) 4 output from light exposure means (not shown) such as slit exposure or laser beam scanning exposure. In this way, electrostatic latent images corresponding to intended images are formed on the surface of the electrophotographic photosensitive member 1 one after another.

When the surface of the electrophotographic photosensitive member 1 is charged by the charging member 3, a voltage with only a direct-current voltage or a voltage with an alternating current voltage superimposed on a direct-current voltage is applied to the charging member 3 from voltage applying means (not shown). In the examples described later, a voltage with only a direct-current voltage (−1200 V) is applied. In the examples described later, a dark part potential is −600 V and a light part potential is −350 V.

The electrostatic latent image formed on the surface of the electrophotographic photosensitive member 1 is developed (reversely developed or normally developed) into a toner image by a toner contained in a developer of a development means 5. Then, toner images formed and borne on the surface of the electrophotographic photosensitive member 1 are sequentially transferred to a transfer material (paper or the like) P taken out to an area (contact area) between the electrophotographic photosensitive member 1 and transfer means 6 from transfer material feeding means (not shown) in synchronization with rotation of the electrophotographic photosensitive member 1 and fed, by a transfer bias from the transfer means (transfer roller or the like) 6.

Development means includes, for example, jumping development means, contact development means and magnetic blush means, but contact development means is preferable in terms of improvement of the scattering characteristic of the toner, and contact development means is employed in the examples described later.

For the transfer roller, one made by covering the support with an elastic resin layer adjusted to have a medium resistance is illustrated.

The transfer material P to which the toner image has been transferred is separated from the surface of the electrophotographic photosensitive member 1 and introduced into fixation means 8 to have an image fixed thereon, whereby it is printed out to outside the apparatus as an image-formed product (print, copy). In the case of a double side image formation mode and a multiple image formation mode, this image-formed product is introduced into a recycle conveyor mechanism (not shown) and reintroduced into a transfer portion.

The surface of the electrophotographic photosensitive member 1 to which the toner image has been transferred is cleared of post-transfer residual developer (toner) into a cleaned surface by cleaning means (cleaning blade or the like) 7, further subjected to static elimination processing by pre-exposure light (not shown) from pre-light exposure means (not shown), and then used again for image formation. If charging means is contact charging means, pre-exposure is not necessarily required.

A plurality of components of components such as the electrophotographic photosensitive member 1, the charging member 3, the development means 5, the transfer means 6 and the cleaning means 7 are housed in a container and integrally coupled as a process cartridge, and this process cartridge may be configured to be detachably attached to a body of an electrophotographic apparatus such as a copier or laser beam printer. In FIG. 8, the electrophotographic photosensitive member 1, the charging member 3, the development means 5 and the cleaning means 7 are integrally supported to form a cartridge as a process cartridge 9 which can be detachably attached to the electrophotographic photosensitive apparatus body using guide means 10 such as a rail of the electrophotographic apparatus body.

The present invention will be described further in detail with specific examples. However, the present invention is not limited thereto. The "part(s)" in examples means "part(s) by mass".

Example 1

100 parts of epichlorohydrin rubber (trade name: Epichlomer CG105 manufactured by Daiso Co., Ltd.), 35 parts of MT carbon (trade name: N990 manufactured Thermax Co., Ltd.) as a filler, 5 parts of surface treatment baked kaolin (trade name: ST-KE Harges Pigment Co., Ltd.), 5 parts of zinc oxide and 1 part of stearic acid were kneaded by an open roll for 30 minutes. To the mixture obtained by kneading for 30 minutes were added 1 part of di-2-benzothiazolyldisulfide (trade name: NOCCELER DM-P manufactured by Ouchi Shinko Chemical Co., Ltd.) as a curing accelerator, 0.5 parts of tetramethylthiurammonosulfide (trade name: NOCCELER TS manufactured by Ouchi Shinko Chemical Co., Ltd.) as a curing accelerator, and 1.2 parts of sulfur as a curing agent, and the resultant mixture was further kneaded by the open roll for 15 minutes to obtain a kneaded matter I.

Then, the kneaded matter I was extruded into a cylinder having an outer diameter of 9.5 mm and an inner diameter of 5.4 mm by a rubber extruder, cut into a length of 250 mm, and primarily cured with 160° C. steam in a curing can for 30 minutes to obtain a primary curing tube I for a conductive elastic layer.

A thermoset adhesive including a metal and a rubber (trade name: METALOC U-20 manufactured by Toyokagaku Kenkyujyo Co., Ltd.) was coated on a region extending 115.5 mm on both sides with a center in a cylindrical surface axial direction situated therebetween (region having an axial width of 231 mm in total) in a cylindrical steel support (with a nickel-plated surface) having a diameter of 6 mm and a length of 256 mm, dried at 80° C. for 30 minutes, and then further dried at 120° C. for 1 hour.

The support with the thermoset adhesive coated on the cylindrical surface and dried was inserted into the primary curing tube I for a conductive elastic layer, and the primary curing tube I for a conductive elastic layer was then heated at 160° C. for 1 hour. By this heating, the primary curing tube I for a conductive elastic layer was secondarily cured, and the thermoset adhesive was cured. In this way, a conductive elastic roller I before surface polishing was obtained.

Then, both terminals of a conductive elastic layer area (rubber area) of the conductive elastic roller I before surface polishing were cut off so that the axial width of the conductive elastic layer area was 231 mm, and the surface of the conductive elastic layer area was then polished by a rotating grinder to obtain a conductive elastic roller (conductive elastic roller after surface polishing) I which had a crown shape having a terminal section diameter of 8.2 mm and a center section diameter of 8.5 mm, and of which the ten point height of irregularities (Rz) on the surface was 5.5 μm and deviation was 22 μm.

The ten points average surface roughness (Rz) was measured in accordance with JISB6101.

The deviation was measured using High Precision Laser Measuring Machine LSM-430v manufactured by Mitutoyo Co., Ltd. Specifically, the outer diameter was measured using the measuring machine, a difference between the value of the maximum outer diameter and the value of the minimum outer diameter was determined to be an outer diameter difference deviation, this measurement was made at 5 points, and the average value of outer diameter difference deviations at 5 points was determined to be a deviation of the measurement object.

The hardness of the obtained conductive elastic roller (conductive elastic roller after surface polishing) I was 74 degrees (Asker C), and the surface free energy was 39.8 mJ/m$^2$.

Then, 99 parts of copolymer of a siloxane (77% by mass) having an isocyanate group on its terminal and polyester components (23% by mass), which had the following compositions:

siloxane having an isocyanate group on its terminal:

$HO(CH_2)_3O[SiO(CH_3)_2]_n(CH_2)_3NCO$ (average of n: 400); and polyester components:

terephthalic acid component: 8.2 mol %;

isophthalic acid component: 26.2 mol %;

sebacic acid component: 13.1 mol %;

ethylene glycol component: 16.4 mol %; and neopentyl glycol component: 36.1 mol %, and 1 part of 3-(methacryloxy)propyltrimethoxysilane as the hydrolyzable compound having the structure expressed by the formula (4) were added to a mixed solvent of ethyl acetate/toluene (mass ratio: 25/1) to prepare a treatment agent I having a solid content of 2% by mass.

This treatment agent I was ring-coated on the conductive elastic roller (conductive elastic roller after surface polishing) I to impregnate the surface region of the conductive elastic layer of the conductive elastic roller I with the treatment agent I.

Then, ultraviolet light having a wavelength of 254 nm was applied to the surface region of the conductive elastic layer impregnated with the treatment agent I in an integrated light amount of 9000 mJ/cm$^2$, whereby the surface region was modified. For application of ultraviolet light, a low pressure mercury lamp manufactured by Harison Toshiba Lighting Co., Ltd. was used.

In the manner described above, a charge roller comprising a support, a conductive elastic layer (unmodified region of the conductive elastic layer of the conductive elastic roller I) formed on the support, and a surface layer (modified surface region of the conductive elastic layer of the conductive elastic roller I) formed on the conductive elastic layer was fabricated. This charge roller is a charge roller I.

The surface free energy ($\gamma_2^{Total}$) of the fabricated charge roller I was 29.1 mJ/m$^2$, the dynamic friction coefficient (μ) of the surface was 0.23, and the electrostatic capacity (C) of the surface layer was $1.65\times10^{-8}$ F.

Evaluation of charge roller

Evaluation I

The fabricated charge roller I was used to carry out the bleed-out test and evaluation described below.

First, the fabricated charge roller I and an electrophotographic photosensitive member were incorporated in a process cartridge integrally supporting them, and this process cartridge was left standing an a high-temperature and high-humidity bath at 40° C./95% RH for a week.

The electrophotographic photosensitive member incorporated in the process cartridge together with the charge roller I is an organic electrophotographic photosensitive member made by forming an organic photosensitive layer having a thickness of 14 μm formed on a support. This organic photosensitive layer is a layered photosensitive layer made by stacking a charge generation layer and a charge transport layer containing modified polycarbonate (binding resin) from the support side, and this charge transport layer is the surface layer of the electrophotographic photosensitive member.

After being left standing for a week, the charge roller I and the electrophotographic photosensitive member were taken out from the process cartridge, and a contact area between the charge roller I and the electrophotographic photosensitive member was observed by a light microscope to check whether or not a matter bleeding out from the charge roller I (bleeding matter) was deposited on the contact area.

Evaluation criteria are as follows.

A: No bleeding matter is deposited.

C: A bleeding matter is deposited.

Evaluation 2

The charge roller I fabricated in the same manner as described above was used to carry out the evaluation of output images described below.

The fabricated charge roller I and an electrophotographic photosensitive member were incorporated in a process cartridge integrally supporting them, and this process cartridge was mounted on a laser beam printer for longitudinal output of A4 sheets. The development system of this laser beam printer is a reversal development system, the transfer material output speed is 47 mm/s, and the image resolution is 600 dpi.

The electrophotographic photosensitive member incorporated In the process cartridge together with the charge roller I is same as that described above.

The toner used in the above-mentioned laser beam printer is so called a polymerization toner containing toner particles made by externally adding silica fine particles and titanium oxide fine particles to particles obtained by suspension-polymerizing in an aqueous medium a polymerizable monomer system containing wax, a charge controlling agent, pigments, styrene, butyl acrylate and an ester monomer, and its glass transition temperature is 63° C. and its volume average particle diameter is 6 μm.

Image output was carried out under an environment of 30° C./80% RH, a halftone image (image in which horizontal lines having a width of 1 dot and an interval of 2 dots in the direction of rotation of the electrophotographic photosensitive member and the vertical direction) was formed on an A4 sheet, and 6000 such A4 sheet bearing halftone images were output at a process speed of 47 mm/s.

The evaluation of the output image was carried out by visually observing the output image at an interval of 1000 sheets.

Evaluation criteria are as follows.

AA: charge unevenness due to a toner and additives adhering to the surface of the charge roller cannot be observed on the output image.

A: Little charge unevenness due to a toner and additives adhering to the surface of the charge roller can be observed on the output image.

B: Charge unevenness due to a toner and additives adhering to the surface of the charge roller can be observed on the output image.

C: Charge unevenness due to a toner and additives adhering to the surface of the charge roller can be observed on the output image, and the degree of the charge unevenness is significant. Specifically, the charge unevenness is charge unevenness of white vertical stripes.

The results of the evaluation described above are shown in Table 5.

Example 2

A conductive elastic roller (conductive elastic roller after surface polishing) II was obtained in the same manner as in Example 1 except that the kneaded matter I was changed to a kneaded matter II described below in Example 1.

The kneaded matter II was prepared as follows.

Specifically, 75 parts of epichlorohydrin rubber (trade name: Epichlomer CG105 manufactured by Daiso Co., Ltd.), 25 parts of nitrile butadiene rubber (NBR) (trade name: N230S manufactured by JSR Co., Ltd.), 35 parts of MT carbon (trade name: HTC #20 manufactured by Shinnikka Carbon Co., Ltd.) as a filler, 5 parts of zinc oxide and 1 part of stearic acid were kneaded by an open roll for 30 minutes. To the mixture obtained by kneading for 30 minutes were added 1 part of di-2-benzothiazolyldisulfide (trade name: NOCCELER DM-P manufactured by Ouchi Shinko Chemical Co., Ltd.) as a curing accelerator, 2.5 parts of tetrabutylthiuramdisulfide (trade name: NOCCELER TBT manufactured by Ouchi Shinko Chemical Co., Ltd.) as a curing accelerator, and 0.8 parts of sulfur as a curing agent, and the resultant mixture was further kneaded by the open roll for 15 minutes to obtain a kneaded matter II.

The hardness of the obtained conductive elastic roller (conductive elastic roller after surface polishing) II was 71 degrees (Asker C), and the surface free energy was 39.4 mJ/m$^2$.

Then, the treatment agent I used in Example 1 was ring-coated on the conductive elastic roller (conductive elastic roller after surface polishing) II to impregnate the surface region of the conductive elastic layer of the conductive elastic roller II with the treatment agent I.

Then, ultraviolet light having a wavelength of 254 nm was applied to the surface region of the conductive elastic layer impregnated with the treatment agent I in an integrated light amount of 4350 mJ/cm$^2$, whereby the surface region was modified. For application of ultraviolet light, a low pressure mercury lamp manufactured by Harison Toshiba Lighting Co., Ltd. was used.

In the manner described above, a charge roller comprising a support, a conductive elastic layer (unmodified region of the conductive elastic layer of the conductive elastic roller II) formed on the support, and a surface layer (modified surface region of the conductive elastic layer of the conductive elastic roller II) formed on the conductive elastic layer was fabricated. This charge roller is a charge roller II.

The surface free energy ($\gamma_2^{Total}$) of the fabricated charge roller II was 29.1 mJ/m$^2$, the dynamic friction coefficient (μ) of the surface was 0.18, and the electrostatic capacity (C) of the surface layer was $1.02\times10^{-8}$ F.

The evaluation of the charge roller II was carried out in the same manner as in the evaluation of the charge roller I of Example 1. The results of the evaluation are shown in Table 5.

Example 3

A conductive elastic roller III before surface polishing was obtained in the same manner as in Example 1 except that the kneaded matter I was changed to a kneaded matter III described below in Example 1.

The kneaded matter III was prepared as follows.

Specifically, 100 parts of epichlorohydrin rubber (trade name: Epichlomer CG102 manufactured by Daiso Co., Ltd.), 35 parts of MT carbon (trade name: HTC #20 manufactured by Shinnikka Carbon Co., Ltd.) as a filler, 5 parts of bentonite (trade name: Bengel SH manufactured by Hojun Co., Ltd.), 5 parts of zinc oxide and 1 part of stearic acid were kneaded by an open roll for 30 minutes. To the mixture obtained by kneading for 30 minutes were added 1 part of di-2-benzothiazolyldisulfide (trade name: NOCCELER DM-P manufactured by Ouchi Shinko Chemical Co., Ltd.) as a curing accelerator, 1 part of tetramethylthiurammonosulfide (trade name: NOCCELER TS manufactured by Ouchi Shinko Chemical Co., Ltd.) as a curing accelerator, and 1.2 parts of sulfur as a curing agent, and the resultant mixture was further kneaded by the open roll for 15 minutes to obtain a kneaded matter III.

Then, both terminals of a conductive elastic layer area (rubber area) of the conductive elastic roller III before surface polishing were cut off so that the axial width of the conductive elastic layer area was 231 mm, and the surface of the conductive elastic layer area was then polished by a rotating grinder to obtain a conductive elastic roller (conductive elastic roller after surface polishing) III which had a crown shape having a terminal section diameter of 8.2 mm and a center section diameter of 8.5 mm, and in which the ten points average surface roughness (Rz) was 4.9 μm and the deviation was 22 μm.

The hardness of the obtained conductive elastic roller (conductive elastic roller after surface polishing) III was 72 degrees (Asker C), and the surface free energy was 36.4 mJ/m$^2$.

Then, 98 parts of copolymer of a siloxane (64% by mass) having an isocyanate group on its terminal and a polystyrene component (36% by mass), which had the following compositions:

siloxane having an isocyanate group on its terminal:

$HO(CH_2)_3O[SiO(CH_3)_2]_n(CH_2)_3NCO$ (average of n: 400); and polystyrene component:

polystyrene (narrowly defined polystyrene), and 2 parts of methyltris (methylethylketoxym) as the hydrolyzable compound having the structure expressed by the formula (4) were added to a mixed solvent of ethyl acetate/toluene (mass ratio: 25/1) to prepare a treatment agent III having a solid content of 5% by mass.

This treatment agent III was ring-coated on the conductive elastic roller (conductive elastic roller after surface polishing) III to impregnate the surface region of the conductive elastic layer of the conductive elastic roller III with the treatment agent III.

Then, ultraviolet light having a wavelength of 254 nm was applied to the surface region of the conductive elastic layer impregnated with the treatment agent III in an integrated light amount of 4350 mJ/cm, whereby the surface region was modified. For application of ultraviolet light, an excimer UV lamp manufactured by Harison Toshiba Lighting Co., Ltd. was used.

In the manner described above, a charge roller comprising a support, a conductive elastic layer (unmodified region of the conductive elastic layer of the conductive elastic roller III) formed on the support, and a surface layer (modified surface region of the conductive elastic layer of the conductive elastic roller III) formed on the conductive elastic layer was fabricated. This charge roller is a charge roller III.

The surface free energy ($\gamma_2^{Total}$) of the fabricated charge roller III was 25.5 mJ/m$^2$, the dynamic friction coefficient ($\mu$) of the surface was 0.26, and the electrostatic capacity (C) of the surface layer was $1.84\times10^{-8}$ F.

The evaluation of the charge roller III was carried out in the same manner as in the evaluation of the charge roller I of Example 1. The results of the evaluation are shown in Table 5.

Example 4

A charge roller was fabricated in the same manner as in Example 3 except that the integrated amount of ultraviolet light having a wavelength of 254 nm in application of ultraviolet light was changed from 4350 J/cm$^2$ to 8700 J/cm$^2$ in Example 3. This charge roller is a charge roller IV.

The surface free energy ($\gamma_2^{Total}$) of the fabricated charge roller IV was 24.9 mJ/m$^2$, the dynamic friction coefficient ($\mu$) of the surface was 0.22, and the electrostatic capacity (C) of the surface layer was $9.51\times10^{-9}$ F.

The evaluation of the charge roller IV was carried out in the same manner as in the evaluation of the charge roller I of Example 1. The results of the evaluation are shown in Table 5.

Example 5

A conductive elastic roller (conductive elastic roller after surface polishing) III was fabricated in the same manner as in Example 3.

Then, 27.84 g (0.1 mol) of glycidoxypropyltriethoxysilane (GPTES), 17.83 g (0.1 mol) of methyltriethoxysilane (MTES) and 6.6 g (0.0151 mol (equivalent to 7 mol % based on the total amount of hydrolyzable silane compound)) of tridecafluoro-1,1,2,2-tetrahydrooctyltriethoxysilane (FTS, perfluoroalkyl group having 6 carbon atoms) as hydrolyzable silane compounds, and 17.43 g of water and 37.88 g of ethanol were mixed, and the resultant mixture was then stirred at room temperature, and then refluxed while heating for 24 hours, whereby a hydrolyzable silane compound condensate V was obtained.

This condensate V was added to a mixed solvent of 2-butanol/ethanol to prepare a condensate-containing alcohol solution V having a solid content of 7% by mass.

0.35 g of aromatic sulfonium salt (trade name: ADEKA optomer SP-150 manufactured by Asahi Denka Co., Ltd.) as a photo cationic polymerization initiator was added to 1100 g of the condensate-containing alcohol solution V to prepare a coating solution V for a surface layer.

Then, the coating solution V for a surface layer was ring-coated on the conductive elastic layer of the conductive elastic roller (conductive elastic roller after surface polishing) III, ultraviolet light having a wavelength of 254 nm was applied thereto in an integrated light amount of 9000 mJ/cm$^2$, and the coating solution V for a surface layer was cured (cured by a crosslinking reaction) and dried to form a surface layer. For application of ultraviolet light, a low pressure mercury lamp manufactured by Harison Toshiba Lighting Co., Ltd. was used.

It is conceivable that by application of ultraviolet light, the glycide group of glycidoxypropyltriethoxysilane was cleaved to cause the crosslinking reaction of the condensate V.

In the manner as described above, a charge roller comprising a support, a conductive elastic layer (same as the conductive elastic layer of the conductive elastic roller III) formed on the support, and a surface layer (layer containing a polysiloxane formed using the coating solution V for a surface layer) formed on the conductive elastic layer was fabricated. This charge roller is a charge roller V.

The surface free energy ($\gamma_2^{Total}$) of the fabricated charge roller V was 18.4 mJ/m$^2$, the dynamic friction coefficient ($\mu$) of the surface was 0.26, and the electrostatic capacity (C) of the surface layer was $1.43\times10^{-8}$ F.

The evaluation of the charge roller V was carried out in the same manner as in the evaluation of the charge roller I of Example 1. The results of the evaluation are shown in Table 5.

The composition of the surface layer of the charge roller V was analyzed as follows.

Under a light microscope of 10 to 1000 magnifications, a three-dimensional coarse/fine adjustment micromanipulator (manufactured by Narishige Co., Ltd.) installed on the light microscope was used to take about 1 mg of sample from the surface layer of the charge roller V fabricated in the same manner as described above.

A change in concentration of the taken sample for mass number of a gas generated during heating was pursued together with a change in mass as a function of temperature by the TG-MS method (directly coupling MS apparatus to TG apparatus). Conditions for measurement are shown in Table 2.

TABLE 2

| | | |
|---|---|---|
| Apparatus | TG apparatus | TG-40 Model manufactured by Shimadzu Corporation |
| | MS apparatus | GC/MS QP1000 (1) manufactured by Shimadzu Corporation |
| Measurement conditions | Start of measurement | Sample is set on TG apparatus, a carrier gas is then made to flow for 15 minutes or longer, after which heat-up is started. |

TABLE 2-continued

| | | |
|---|---|---|
| | Heating condition | Room temperature to 1000° C. (rate of temperature increase: 20° C./min) |
| MS sensitivity | gain 3.5 | |
| Mass number range | m/z = 10~300<br>m of m/z represents a mass number, and z represents a valence of an ion. Since the valence of an ion is normally 1, m/z corresponds to a mass number. | |
| Atmosphere | Helium (He) stream (30 ml/min) | |

According to a TG-DTG (derivative thrmogravimetry) curve obtained by making measurements under the above-mentioned conditions, a weight loss was recognized beginning at a temperature around room temperature, and a two-stage noticeable weight loss was recognized beginning at a temperature around 400 to 500° C. and around 500 to 650° C.

Here, for a gas generated at 400° C. to 500° C., oxyalkylene groups (originating from glycidoxy groups of glycidoxypropyltriethoxysilane) having mass numbers (m/z) of 31, 43, 58 and 59 could be observed, and from the rate of the weight loss, it was found that the content of the oxyalkylene group in the polysiloxane was 37.36% by mass based on the total mass of polysiloxane.

For a gas generated at 500° C. to 600° C., fluoroalkyl groups (originating from fluoroalkyl groups of tridecafluoro-1,1,2,2-tetrahydrooctyltriethoxysilane) having mass numbers (m/z) of 51, 69, 119 and 131 could be observed, and from the rate of the weight loss, it was found that the content of the fluoroalkyl group in the polysiloxane was 19.20% by mass based on the total mass of polysiloxane.

It is conceivable that the residue is a siloxane moiety in the polysiloxane, and therefore the content of the siloxane moiety in the polysiloxane is 100.00−(37.36+19.20)=43.44% by mass based on the total mass of polysiloxane.

Example 6

A charge roller was fabricated in the same manner as in Example 5 except that the coating solution V for a surface layer was changed to a coating solution VI for a surface layer described below in Example 5. This charge roller is a charge roller VI.

The coating solution VI for a surface layer was prepared as follows.

Specifically, 27.84 g (0.1 mol) of glycidoxypropyltriethoxysilane (GPTES), 17.83 g (0.1 mol) of methyltriethoxysilane (MTES) and 3.34 g (0.0047 mol (equivalent to 2.3 mol % based on the total amount of hydrolyzable silane compound)) of tridecafluoro-1,1,2,2-tetrahydrooctyltriethoxysilane (FTS, perfluoroalkyl group having 10 carbon atoms) as hydrolyzable silane compounds, and 16.6 g of water and 31.7 g of ethanol were mixed, and the resultant mixture was then stirred at room temperature, and then refluxed while heating for 24 hours, whereby a hydrolyzable silane compound condensate VI was obtained.

This condensate VI was added to a mixed solvent of 2-butanol/ethanol to prepare a condensate-containing alcohol solution VI having a solid content of 7% by mass.

0.35 g of aromatic sulfonium salt (trade name: ADEKA optomer SP-150 manufactured by Asahi Denka Co., Ltd.) as a photo cationic polymerization initiator was added to 3100 g of the condensate-containing alcohol solution VI to prepare a coating solution VI for a surface layer.

The surface free energy ($\gamma_2^{Total}$) of the fabricated charge roller VI was 22.1 mJ/m$^2$, the dynamic friction coefficient (μ) of the surface was 0.26, and the electrostatic capacity (C) of the surface layer was $4.78\times10^{-8}$ F.

The evaluation of the charge roller VI was carried out in the same manner as in the evaluation of the charge roller I of Example 1. The results of the evaluation are shown in Table 5.

The composition of the surface layer of the charge roller VI was analyzed in the same manner as in the analysis of the composition of the surface layer of the charge roller V in Example 5, and it was found that the content of the oxyalkylene group in the polysiloxane was 40.00% by mass based on the total mass of polysiloxane, the content of the fluoroalkyl group in the polysiloxane was 11.90% by mass based on the total mass of polysiloxane, and the content of the siloxane moiety in the polysiloxane was 48.10% by mass based on the total mass of polysiloxane.

Example 7

A charge roller was fabricated in the same manner as in Example 5 except that the coating solution V for a surface layer was changed to a coating solution VII for a surface layer described below in Example 5. This charge roller is a charge roller VII.

The coating solution VII for a surface layer was prepared as follows.

Specifically, 27.84 g (0.1 mol) of glycidoxypropyltriethoxysilane (GPTES), 24.04 g (0.1 mol) of phenyltriethoxysilane (PhTES) and 7.68 g (0.0151 mol (equivalent to 7 mol % based on the total amount of hydrolyzable silane compound)) of tridecafluoro-1,1,2,2-tetrahydrooctyltriethoxysilane (FTS, perfluoroalkyl group having 6 carbon atoms) as hydrolyzable silane compounds, and 17.43 g of water and 53.82 g of ethanol were mixed, and the resultant mixture was then stirred at room temperature, and then refluxed while heating for 24 hours, whereby a hydrolyzable silane compound condensate VII was obtained.

This condensate VII was added to a mixed solvent of 2-butanol/ethanol to prepare a condensate-containing alcohol solution VII having a solid content of 7% by mass.

0.35 g of aromatic sulfonium salt (trade name: ADEKA optomer SP-150 manufactured by Asahi Denka Co., Ltd.) as a photo cationic polymerization initiator was added to 5100 g of the condensate-containing alcohol solution VII to prepare a coating solution VII for a surface layer.

The surface free energy ($\gamma_2^{Total}$) of the fabricated charge roller VII was 19.1 mJ/m$^2$, the dynamic friction coefficient (μ) of the surface was 0.27, and the electrostatic capacity (C) of the surface layer was $3.54\times10^{-8}$ F.

The evaluation of the charge roller VII was carried out in the same manner as in the evaluation of the charge roller I of Example 1. The results of the evaluation are shown in Table 5.

The composition of the surface layer of the charge roller VII was analyzed in the same manner as in the analysis of the composition of the surface layer of the charge roller V in Example 5, and it was found that the content of the oxyalkylene group in the polysiloxane was 33.50% by mass based on the total mass of polysiloxane, the content of the fluoroalkyl group in the polysiloxane was 12.90% by mass based on the total mass of polysiloxane, the content of the phenyl group in the polysiloxane was 6.70% by mass based on the total mass of polysiloxane, and the content of the siloxane moiety in the polysiloxane was 46.90% by mass based on the total mass of polysiloxane. For a gas generated at 400° C. to 500° C., benzene having a mass number (m/z) of 78 and a phenyl group having a mass number (m/z) of 91 (toluene) could be observed and from this, the above-mentioned content of phenyl group, i.e. 6.70% by mass was calculated.

Example 8

A charge roller was fabricated in the same manner as in Example 5 except that the coating solution V for a surface layer was changed to a coating solution VIII for a surface layer described below in Example 5. This charge roller is a charge roller VIII.

The coating solution VIII for a surface layer was prepared as follows.

Specifically, 41.43 g (0.149 mol) of glycidoxypropyltriethoxysilane (GPTES), 30.71 g (0.149 mol) of hexyltrimethoxysilane (HeTMS) and 11.42 g (0.0224 mol (equivalent to 7 mol % based on the total amount of hydrolyzable silane compound)) of tridecafluoro-1,1,2,2-tetrahydrooctyltriethoxysilane (FTS, perfluoroalkyl group having 6 carbon atoms) as hydrolyzable silane compounds, and 25.93 g of water and 83.14 g of ethanol were mixed, and the resultant mixture was then stirred at room temperature, and then refluxed while heating for 24 hours, whereby a hydrolyzable silane compound condensate VIII was obtained.

This condensate VIII was added to a mixed solvent of 2-butanol/ethanol to prepare a condensate-containing alcohol solution VIII having a solid content of 7% by mass.

0.35 g of aromatic sulfonium salt (trade name: ADEKA optomer SP-150 manufactured by Asahi Denka Co., Ltd.) as a photo cationic polymerization initiator was added to 7100 g of the condensate-containing alcohol solution VIII to prepare a coating solution VIII for a surface layer.

The surface free energy ($\gamma_2^{Total}$) of the fabricated charge roller VIII was 16.5 mJ/m$^2$, the dynamic friction coefficient ($\mu$) of the surface was 0.25, and the electrostatic capacity (C) of the surface layer was $2.38\times10^{-8}$ F.

The evaluation of the charge roller VIII was carried-out in the same manner as in the evaluation of the charge roller I of Example 1. The results of the evaluation are shown in Table 5.

The composition of the surface layer of the charge roller VIII was analyzed in the same manner as in the analysis of the composition of the surface layer of the charge roller V in Example 5, and it was found that the content of the oxyalkylene group in the polysiloxane was 29.18% by mass based on the total mass of polysiloxane, the content of the fluoroalkyl group in the polysiloxane was 12.71% by mass based on the total mass of polysiloxane, the content of the alkyl group in the polysiloxane was 22.50% by mass based on the total mass of polysiloxane, and the content of the siloxane moiety in the polysiloxane was 35.61% by mass based on the total mass of polysiloxane. For a gas generated at 400° C. to 500° C., alkyl groups having mass numbers (m/z) of 16, 41 and so on could be observed and from this, the above-mentioned content of alkyl group, i.e. 22.50% by mass was calculated.

Example 9

A charge roller was fabricated in the same manner as in Example 5 except that the coating solution V for a surface layer was changed to a coating solution IX for a surface layer described below in Example 5. This charge roller is a charge roller IX.

The coating solution IX for a surface layer was prepared as follows.

Specifically, 32.52 g (0.117 mol) of glycidoxypropyltriethoxysilane (GPTES), 28.08 g (0.117 mol) of phenyltriethoxysilane (PhTES), 13.21 g (0.064 mol) of hexyltrimethoxysilane (HeTMS) and 11.42 g (0.022 mol (equivalent to 7 mol % based on the total amount of hydrolyzable silane compound)) of tridecafluoro-1,1,2,2-tetrahydrooctyltriethoxysilane (FTS, perfluoroalkyl group having 6 carbon atoms) as hydrolyzable silane compounds, and 25.93 g of water and 77.12 g of ethanol were mixed, and the resultant mixture was then stirred at room temperature, and then refluxed while heating for 24 hours, whereby a hydrolyzable silane compound condensate IX was obtained.

This condensate IX was added to a mixed solvent of 2-butanol/ethanol to prepare a condensate-containing alcohol solution IX having a solid content of 7% by mass.

0.35 g of aromatic sulfonium salt (trade name: ADEKA optomer SP-150 manufactured by Asahi Denka Co., Ltd.) as a photo cationic polymerization initiator was added to 5100 g of the condensate-containing alcohol solution IX to prepare a coating solution IX for a surface layer.

The surface free energy ($\gamma_2^{Total}$) of the fabricated charge roller IX was 15.5 mJ/m$^2$, the dynamic friction coefficient ($\mu$) of the surface was 0.25, and the electrostatic capacity (C) of the surface layer was $5.12\times10^{-8}$ F.

The evaluation of the charge roller IX was carried out in the same manner as in the evaluation of the charge roller I of Example 1. The results of the evaluation are shown in Table 5.

The composition of the surface layer of the charge roller IX was analyzed in the same manner as in the analysis of the composition of the surface layer of the charge roller V in Example 5, and it was found that the content of the oxyalkylene group in the polysiloxane was 13.70% by mass based on the total mass of polysiloxane, the content of the fluoroalkyl group in the polysiloxane was 6.10% by mass based on the total mass of polysiloxane, the content of the alkyl group in the polysiloxane was 10.20% by mass based on the total mass of polysiloxane, the content of the phenyl group in the polysiloxane was 6.40% by mass based on the total mass of polysiloxane, and the content of the siloxane moiety in the polysiloxane was 63.60% by mass based on the total mass of polysiloxane. The contents of alkyl group and phenyl group were calculated in the same manner as in Examples 7 and 8.

Comparative Example 1

A charge roller was fabricated in the same manner as in Example 1 except that the surface region of the conductive elastic layer was not impregnated with the treatment agent I, and ultraviolet light was applied to the surface region of the conductive elastic layer not impregnated with the treatment agent I in Example 1. This charge roller is a charge roller CI.

The surface free energy ($\gamma_2^{Total}$) of the fabricated charge roller CI was 58.2 mJ/m$^2$, the dynamic friction coefficient ($\mu$) of the surface was 0.22, and the electrostatic capacity (C) of the surface layer was $6.10\times10^{-9}$ F.

The evaluation of the charge roller CI was carried out in the same manner as in the evaluation of the charge roller I of Example 1. The results of the evaluation are shown in Table 5.

Comparative Example 2

A charge roller was fabricated in the same manner as in Example 3 except that the surface region of the conductive elastic layer impregnated with the treatment agent III was subjected to a heat treatment (160° C.) for an hour instead of being irradiated with ultraviolet light in Example 3. This charge roller is a charge roller CII.

The surface free energy ($\gamma_2^{Total}$) of the fabricated charge roller CII was 25.5 mJ/m$^2$, the dynamic friction coefficient ($\mu$) of the surface was 1.96, and the electrostatic capacity (C) of the surface layer was $1.51\times10^{-8}$ F.

The evaluation of the charge roller CII was carried out in the same manner as in the evaluation of the charge roller I of Example 1. The results of the evaluation are shown in Table 5.

Comparative Example 3

100 parts of polyesterpolyol for elastomer (trade name: NIPPOLAN 4042 (hydroxyl value: 56 KOH mg/g) manufactured by Nippon Polyurethane Industry Co., Ltd.) and 1 part of conductive carbon (trade name: TOKABLACK #3845 manufactured by Tokai Carbon Co., Ltd.) were kneaded by triple rolls to obtain a kneaded matter CIII.

Then, the kneaded matter CIII was heated to 100° C. and dehydrated under a reduced pressure of 3 mmHg for 3 hours.

Then, 19.1 g of 2,6-tolylenediisocyanate (trade name: COSMONATE T-80 manufactured by Mitsui Chemicals Co., Ltd.) was added to the dehydrated kneaded matter CIII so that the NCO/OH ratio was 1.05, and they were vigorously mixed for 2 to 3 minutes to obtain a composition for a conductive elastic layer.

This composition for a conductive elastic layer was poured into a mold (inner mold is a support similar to the support used in Example 1) heated to 150° C. beforehand, and left standing for 60 minutes to cure the composition for a conductive elastic layer, the mold was then removed, and the composition for a conductive elastic layer was further cured at 110° C. for 24 hours. In this way, a conductive elastic roller CIII was obtained.

The surface free energy of the obtained conductive elastic roller CIII was 25.5 mJ/m$^2$.

Then, 100 parts of urethane resin (trade name: RESAMINE ME44-ELP manufactured by Dainichiseika Color & Chemicals Mfg. Co., Ltd.), 1.3 parts of fluorine based modifier (trade name: DAIAROMER FF-101(D) manufactured by Dainichiseika Color & Chemicals Mfg. Co., Ltd.) and 0.05 parts of leveling resin (trade name: GS-30 manufactured by Toagosei Co., Ltd.) were dissolved in a mixed solvent of 177 parts of methyl ethyl ketone and 98 parts of dimethyl formamide to prepare a coating solution CIII for a surface layer.

This coating solution CIII for a surface layer was dip-coated on the conductive elastic layer of the conductive elastic roller CIII, and dried at 100° C. for 30 minutes to form a surface layer having a thickness of 15 μm.

In this way, a charge roller comprising a support, a conductive elastic layer formed on the support, and a surface layer formed on the conductive elastic layer was fabricated. This charge roller is a charge roller CIII.

The surface free energy ($\gamma_2^{Total}$) of the fabricated charge roller CIII was 30.0 mJ/m$^2$, the dynamic friction coefficient (μ) of the surface was 0.32, and the electrostatic capacity (C) of the surface layer was $1.83\times10^{-9}$ F.

The evaluation of the charge roller CIII was carried out in the same manner as in the evaluation of the charge roller I of Example 1. The results of the evaluation are shown in Table 5.

Comparative Example 4

A conductive elastic roller (conductive elastic roller after surface polishing) CIV was obtained in the same manner as in Example 1 except that the kneaded matter I was changed to a kneaded matter CIV described below in Example 1.

The kneaded matter CIV was prepared as follows.

Specifically, 100 parts of epichlorohydrin rubber (trade name: Epichlomer CG102 manufactured by Daiso Co., Ltd.), 5 parts of MT carbon (trade name: HTC #20 manufactured by Shinnikka Carbon Co., Ltd.) as a filler, 5 parts of zinc oxide, 1 part of stearic acid, 5 parts of bis(2-ethylhexyl) adipate (trade name: DOA manufactured by J-Plus Co., Ltd.) as a plasticizer and 1 part of quaternary ammonium perchlorate as an ion conducting agent were kneaded by an open roll for 30 minutes. To the mixture obtained by kneading for 30 minutes were added 1 part of di-2-benzothiazolyldisulfide (trade name: NOCCELER DM-P manufactured by Ouchi Shinko Chemical Co., Ltd.) as a curing accelerator, 1.0 part of tetramethylthiurammonosulfide (trade name: NOCCELER TS manufactured by Ouchi Shinko Chemical Co., Ltd.) as a curing accelerator, and 1.2 parts of sulfur as a curing agent, and the resultant mixture was further kneaded by the open roll for 15 minutes to obtain a kneaded matter CIV.

For the obtained conductive elastic roller (conductive elastic roller after surface polishing) CIV, the ten points average surface roughness (Rz) was 5.6 μm, the deviation was 28 μm, the hardness was 70 degrees (Asker C), and the surface free energy was 44.0 mJ/m$^2$.

Then, 42.9 parts of lactone modified acrylpolyol (trade name: Placcel DC2016 (hydroxyl value: 80 KOH mg/g) manufactured by Daicel Chemical Industries, Ltd.) were dissolved in 557.1 parts of methyl isobutyl ketone (MIBK) to prepare a solution having a solid content of 5.0% by mass. 200 parts of this solution were mixed with 10.7 parts of isocyanurate type trimer of block type of isophoronediisocyanate (IPDI) (trade name: Vestanat B1370 manufactured by Degussa Huels Co., Ltd.), the resultant mixture was stirred by a ball mill for an hour, and thereafter the solution was filtered through a net of 200 meshes to prepare a coating solution CIV for a surface layer.

Then, the coating solution CIV for a surface layer was ring-coated on the conductive elastic layer of the conductive elastic roller (conductive elastic roller after surface polishing) CIV, ultraviolet light having a wavelength of 172 nm was applied thereto in an integrated light amount of 4350 mJ/cm$^2$, and the coating solution CIV for a surface layer was cured and dried to form a surface layer. For application of ultraviolet light, an excimer UV lamp manufactured by Harison Toshiba Lighting Co., Ltd. was used.

In this way, a charge roller comprising a support, a conductive elastic layer formed on the support, and a surface layer formed on the conductive elastic layer was fabricated. This charge roller is a charge roller CIV.

The surface free energy ($\gamma_2^{Total}$) of the fabricated charge roller CIV was 37.5 mJ/m$^2$, the dynamic friction coefficient (μ) of the surface was 0.24, and the electrostatic capacity (C) of the surface layer was $2.06\times10^{-9}$ F.

The evaluation of the charge roller CIV was carried out in the same manner as in the evaluation of the charge roller I of Example 1. The results of the evaluation are shown in Table 5.

Comparative Example 5

A charge roller was fabricated in the same manner as in Example 5 except that the coating solution V for a surface layer was changed to a coating solution CV for a surface layer described below in Example 5. This charge roller is a charge roller CV.

The coating solution CV for a surface layer was prepared as follows.

Specifically, 35.04 g (0.128 mol) of glycidoxypropyltriethoxysilane (GPTES), 30.77 g (0.128 mol) of phenyltriethoxysilane (PhTES) and 13.21 g (0.064 mol) of hexyltrimethoxysilane (HeTMS) as hydrolyzable silane compounds, and 25.93 g of water and 63.07 g of ethanol were mixed, and the resultant mixture was then stirred at room temperature, and then refluxed while heating for 24 hours, whereby a hydrolyzable silane compound condensate CV was obtained.

This condensate CV was added to a mixed solvent of 2-butanol/ethanol to prepare a condensate-containing alcohol solution CV having a solid-content of 7% by mass.

0.35 g of aromatic sulfonium salt (trade name: ADEKA optomer SP-150 manufactured by Asahi Denka Co., Ltd.) as a photo cationic polymerization initiator was added to 5100 g of the condensate-containing alcohol solution CV to prepare a coating solution CV for a surface layer.

The surface free energy ($\gamma_2^{Total}$) of the fabricated charge roller CV was 45.1 mJ/m$^2$, the dynamic friction coefficient ($\mu$) of the surface was 0.23, and the electrostatic capacity (C) of the surface layer was $1.23\times10^{-8}$ F.

The evaluation of the charge roller CV was carried out in the same manner as in the evaluation of the charge roller I of Example 1. The results of the evaluation are shown in Table 5.

The composition of the surface layer of the charge roller CV was analyzed in the same manner as in the analysis of the composition of the surface layer of the charge roller V in Example 5, and it was found that the content of the oxyalkylene group in the polysiloxane was 16.30% by mass based on the total mass of polysiloxane, the content of the alkyl group in the polysiloxane was 5.40% by mass based on the total mass of polysiloxane, the content of the phenyl group in the polysiloxane was 9.90% by mass based on the total mass of polysiloxane, and the content of the siloxane moiety in the polysiloxane was 68.40% by mass based on the total mass of polysiloxane.

Comparative Example 6

A charge roller was fabricated in the same manner as in Example 5 except that the coating solution V for a surface layer was changed to a coating solution CVI for a surface layer described below in Example 5. This charge roller is a charge roller CVI.

The coating solution CVI for a surface layer was prepared as follows.

Specifically, 56.16 g (0.234 mol) of phenyltriethoxysilane (PhTES), 13.21 g (0.064 mol) of hexyltrimethoxysilane (HeTMS) and 11.42 g (0.022 mol (equivalent to 7 mol % based on the total amount of hydrolyzable silane compound)) of tridecafluoro-1,1,2,2-tetrahydrooctyltriethoxysilane (FTS, perfluoroalkyl group having 6 carbon atoms) as hydrolyzable silane compounds, and 25.93 g of water and 61.50 g of ethanol were mixed, and the resultant mixture was then stirred at room temperature, and then refluxed while heating for 24 hours, whereby a hydrolyzable silane compound condensate CVI was obtained.

This condensate CVI was added to a mixed solvent of 2-butanol/ethanol to prepare a condensate-containing alcohol solution CVI having a solid content of 7% by mass.

0.35 g of aromatic sulfonium salt (trade name: ADEKA optomer SP-150 manufactured by Asahi Denka Co., Ltd.) as a photo cationic polymerization initiator was added to 5100 g of the condensate-containing alcohol solution CVI to prepare a coating solution CVI for a surface layer.

The surface free energy ($\gamma_2^{Total}$) of the fabricated charge roller CVI was 16.1 mJ/m$^2$, the dynamic friction coefficient ($\mu$) of the surface was 0.46, and the electrostatic capacity (C) of the surface layer was $3.25\times10^{-8}$ F.

The evaluation of the charge roller CVI was carried out in the same manner as in the evaluation of the charge roller I of Example 1. The results of the evaluation are shown in Table 5.

The composition of the surface layer of the charge roller CVI was analyzed in the same manner as in the analysis of the composition of the surface layer of the charge roller V in Example 5, and it was found that the content of the fluoroalkyl group in the polysiloxane was 7.10% by mass based on the total mass of polysiloxane, the content of the alkyl group in the polysiloxane was 5.40% by mass based on the total mass of polysiloxane, the content of the phenyl group in the polysiloxane was 18.00% by mass based on the total mass of polysiloxane, and the content of the siloxane moiety in the polysiloxane was 69.50% by mass based on the total mass of polysiloxane.

The summarized results of measurements in Examples 1 to 9 and Comparative Examples 1 to 6 are shown in Tables 3 and 4.

TABLE 3

| | Conductive elastic layer Thickness [μm] | Surface layer Thickness [μm] | Laminate | ($\gamma_2^{total}$) [mJ/m$^2$] | ($\mu$) | (C) [$\times10^{-8}$ F] |
|---|---|---|---|---|---|---|
| Example 1 | 1249.9 | 0.1 | 2 | 29.1 | 0.23 | 1.65 |
| Example 2 | 1249.9 | 0.1 | 2 | 29.1 | 0.18 | 1.02 |
| Example 3 | 1249.8 | 0.2 | 2 | 25.5 | 0.26 | 1.84 |
| Example 4 | 1249.8 | 0.2 | 2 | 24.9 | 0.22 | 0.951 |
| Example 5 | 1250.0 | 0.3 | 1 | 18.4 | 0.26 | 1.43 |
| Example 6 | 1250.0 | 0.4 | 1 | 22.1 | 0.26 | 4.78 |
| Example 7 | 1250.0 | 0.3 | 1 | 19.1 | 0.27 | 3.54 |
| Example 8 | 1250.0 | 0.5 | 1 | 16.5 | 0.25 | 2.38 |
| Example 9 | 1250.0 | 0.3 | 1 | 15.5 | 0.25 | 5.12 |
| Comparative Example 1 | 1249.8 | 0.2 | 2 | 58.2 | 0.22 | 0.610 |
| Comparative Example 2 | 1249.9 | 0.1 | 2 | 25.5 | 1.96 | 1.51 |
| Comparative Example 3 | 1250.0 | 15 | 1 | 30.0 | 0.32 | 0.183 |
| Comparative Example 4 | 1250.0 | 0.3 | 1 | 37.5 | 0.24 | 0.206 |
| Comparative Example 5 | 1250.0 | 0.4 | 1 | 45.1 | 0.23 | 1.23 |
| Comparative Example 6 | 1250.0 | 0.3 | 1 | 16.1 | 0.46 | 3.25 |

TABLE 4

| | Content in polysiloxane [% by mass] | | | | |
|---|---|---|---|---|---|
| | Oxyalkylene group | Fluoroalkyl group | Alkyl group | Phenyl group | Siloxane moiety |
| Example 5 | 37.36 | 19.20 | — | — | 43.44 |
| Example 6 | 40.00 | 11.90 | — | — | 48.10 |
| Example 7 | 33.50 | 12.90 | — | 6.70 | 46.90 |
| Example 8 | 29.18 | 12.71 | 22.50 | — | 35.61 |
| Example 9 | 13.70 | 6.10 | 10.20 | 6.40 | 63.60 |
| Comparative Example 5 | 16.30 | — | 5.40 | 9.90 | 68.40 |
| Comparative Example 6 | — | 7.10 | 5.40 | 18.00 | 69.50 |

TABLE 5

| | Evaluation 1 | Evaluation 2 | | | | | | |
|---|---|---|---|---|---|---|---|---|
| | | Start | After 1000 sheets | After 2000 sheets | After 3000 sheets | After 4000 sheets | After 5000 sheets | After 6000 sheets |
| Example 1 | A | AA | AA | AA | AA | AA | AA | AA |
| Example 2 | A | AA | AA | AA | AA | AA | AA | AA |
| Example 3 | A | AA | AA | AA | AA | A | A | A |
| Example 4 | A | AA | AA | AA | AA | AA | A | A |
| Example 5 | A | AA | AA | AA | AA | AA | AA | AA |
| Example 6 | A | AA | AA | AA | AA | AA | AA | AA |
| Example 7 | A | AA | AA | AA | AA | AA | AA | AA |
| Example 8 | A | AA | AA | AA | AA | AA | AA | AA |
| Example 9 | A | AA | AA | AA | AA | AA | AA | AA |
| Comparative Example 1 | A | AA | B | C | C | C | C | C |
| Comparative Example 2 | A | AA | B | B | B | B | C | C |
| Comparative Example 3 | C | AA | B | B | C | C | C | C |
| Comparative Example 4 | C | AA | A | B | C | C | C | C |
| Comparative Example 5 | C | A | B | C | C | C | C | C |
| Comparative Example 6 | A | A | B | C | C | C | C | C |

As described above, according to the present invention, a charging member in which a toner, an additive for use in the toner, or the like is hard to adhere to the surface even under repeated use for a long time, and hence the charging and image output are made stable for a long time even if the charging member is used in the DC contact charging method, and a process cartridge and an electrophotographic apparatus having the charging member can be provided.

This application claims priority from Japanese Patent Application Nos. 2004-255692 filed on Sep. 2, 2004, 2004-379828 filed on Dec. 28, 2004, 2005-149452 filed on May 23, 2005 and 2005-248687 filed on Aug. 30, 2005 which are hereby incorporated by reference herein.

The invention claimed is:

1. A charging member comprising an electroconductive support, a conductive elastic layer formed on the electroconductive support, and a surface layer formed on the conductive elastic layer, wherein the surface layer is a layer formed through steps (VII) and (VIII):

(VII) an impregnation step of impregnating a surface region of the conductive elastic layer with a treatment agent containing a copolymer and a hydrolyzable compound; and (VIII) an irradiation step of irradiating the surface region of the conductive elastic layer impregnated with the treatment agent with ultraviolet light, the copolymer is a copolymer of a siloxane and polyester components, the polyester components have an acid component and a glycol component, the siloxane has an isocyanate group on its terminal, and the hydrolyzable compound has a structure expressed by the formula (4):

$$(Z^{41})_h\text{-}M^{41}\text{-}(Rh^{41})_{k-h} \quad (4)$$

wherein h is an integer of 1 or larger, and k is an integer of 3 or larger; $Z^{41}$ represents a monovalent organic group; $M^{41}$ represents an element having a valence of k; and $Rh^{41}$ represents a hydrolyzable group.

2. The charging member according to claim 1, wherein M is any element selected from the group consisting of Si, Ti, Al, Sn and Zr.

3. The charging member according to claim 1, wherein M is Si, h is 1, and k is 4.

4. The charging member according to claim 1, wherein the surface layer has properties represented by formulae (i) to (iii):

$$6 < \text{surface free energy}(\gamma_2^{Total}) \leqq 35\ [\text{mJ/m}^2]; \quad \text{(i)}$$

$$0.1 \leqq \text{dynamic friction coefficient of surface}(\mu) \leqq 0.3; \text{ and} \quad \text{(ii)}$$

$$1.0\times10^{-6} \geqq \text{electrostatic capacity}(C) \geqq 5.0\times10^{-9}\ [F] \quad \text{(iii)}.$$

5. The charging member according to claim 4, wherein surface free energy ($\gamma_1^{Total}$) of the conductive elastic layer is 40 mJ/m$^2$ or less, and the $\gamma_1^{Total}$ and the $\gamma_2^{Total}$ have a relationship represented by formula (iv):

$$|\gamma_1^{Total}-\gamma_2^{Total}| \geqq 10\ [\text{mJ/m}^2] \quad \text{(iv)}.$$

6. A process cartridge integrally supporting an electrophotographic photosensitive member and a charging member for charging the surface of the electrophotographic photosensitive member and detachably attached to an electrophotographic apparatus body, wherein the charging member is the charging member according to claim 1.

7. The process cartridge according to claim 6, wherein the charging member is situated so as to be in contact with the electrophotographic photosensitive member.

8. An electrophotographic apparatus comprising an electrophotographic photosensitive member and a charging member for charging the electrophotographic photosensitive member, wherein the charging member is the charging member according to claim 1.

9. The electrophotographic apparatus according to claim 8, wherein the charging member is situated so as to be in contact with the electrophotographic photosensitive member.

10. The electrophotographic apparatus according to claim 8, wherein the electrophotographic apparatus comprises voltage applying means for applying only a direct-current voltage to the charging member.

* * * * *